US011357314B2

(12) United States Patent
Karl, IV et al.

(10) Patent No.: US 11,357,314 B2
(45) Date of Patent: Jun. 14, 2022

(54) HAND-CARRIED HYDRATION BLADDER

(71) Applicant: Shock Doctor, Inc., Fountain Valley, CA (US)

(72) Inventors: Adam Peter Karl, IV, Burlington, VT (US); Benjamin Casey Lanza, Sheldon, VT (US); James Creath Frazier, Hinesburg, VT (US); Bradley Philip Fishkin, Burlington, VT (US); Faith LeAnn Piotrowski, Warminster, PA (US)

(73) Assignee: Shock Doctor, Inc., Fountain Valley, CA (US)

( * ) Notice: Subject to any disclaimer, the term of this patent is extended or adjusted under 35 U.S.C. 154(b) by 0 days.

(21) Appl. No.: 16/205,716

(22) Filed: Nov. 30, 2018

(65) Prior Publication Data

US 2019/0090617 A1 Mar. 28, 2019

Related U.S. Application Data

(63) Continuation of application No. PCT/US2016/035778, filed on Jun. 3, 2016.

(51) Int. Cl.

| | |
|---|---|
| ***A45F 3/20*** | (2006.01) |
| ***A45F 3/18*** | (2006.01) |
| ***A45F 3/16*** | (2006.01) |

(52) U.S. Cl.

CPC ..... *A45F 3/20* (2013.01); *A45F 3/16* (2013.01); *A45F 3/18* (2013.01); *A45F 2003/166* (2013.01)

(58) Field of Classification Search

CPC ..... A45F 3/20; A45F 2003/166; A45F 3/18; A45F 3/16; A45F 2003/205;

(Continued)

(56) References Cited

U.S. PATENT DOCUMENTS

| | | | |
|---|---|---|---|
| 4,486,043 | A | 12/1984 | Rais |
| 4,552,396 | A | 11/1985 | Rais |

(Continued)

FOREIGN PATENT DOCUMENTS

| | | | |
|---|---|---|---|
| CA | 2681941 | A1 | 4/2011 |
| EP | 0652158 | A1 | 5/1995 |

(Continued)

OTHER PUBLICATIONS

International Preliminary Report on Patentaiblity issued in PCT/US2016/035778, dated Dec. 13, 2018, 12 pages.

(Continued)

*Primary Examiner* — Nathan J Newhouse
*Assistant Examiner* — Matthew T Theis
(74) *Attorney, Agent, or Firm* — Faegre Drinker Biddle & Reath LLP

(57) ABSTRACT

A hydration bladder according to an embodiment of the present disclosure includes a flexible body having a first stiffness. A port is coupled to the flexible body. A liquid chamber is formed by the flexible body. The liquid chamber is configured to carry a liquid therein and in is communication with the port. A reinforcement member is coupled to the flexible body. The reinforcement member having a second stiffness, and the second stiffness is greater than the first stiffness. The reinforcement member includes a first width, a second width greater than the first width, and a third width disposed on an opposite of the second width than the first width. The third width is less than the second width.

15 Claims, 26 Drawing Sheets

(58) Field of Classification Search
CPC ..... A45F 2005/008; A45F 2200/0583; A45F 5/10; B65D 25/22; B65D 23/003; B65D 2501/0081; B65D 23/106; A47G 23/0241
USPC ..... 224/148.1–148.7
See application file for complete search history.

(56) References Cited

U.S. PATENT DOCUMENTS

| | | | | |
|---|---|---|---|---|
| 4,660,876 | A | 4/1987 | Weldin et al. | |
| 5,409,151 | A | 4/1995 | Freimark | |
| 5,413,231 | A | 5/1995 | Carroll et al. | |
| 5,765,888 | A | 6/1998 | Stack | |
| 6,086,124 | A | 7/2000 | Wang | |
| 6,131,780 | A | 10/2000 | Becker | |
| 6,385,992 | B1 | 5/2002 | Fiore | |
| D478,509 | S | 8/2003 | DeCotis | |
| 7,490,740 | B2 * | 2/2009 | Robins | A45F 3/20 222/175 |
| 2007/0108239 | A1 | 5/2007 | San Nicholas | |
| 2010/0206919 | A1 | 8/2010 | Boyom | |
| 2011/0089204 | A1 * | 4/2011 | Escalante | A45F 5/00 224/148.3 |
| 2014/0376833 | A1 * | 12/2014 | Lyon | A45F 3/18 383/114 |

FOREIGN PATENT DOCUMENTS

| | | | | |
|---|---|---|---|---|
| EP | 2617656 | A1 | 7/2013 | |
| EP | 2823729 | A1 * | 1/2015 | A45F 5/00 |
| GB | 2451667 | A | 2/2009 | |
| WO | WO-2011003110 | A2 * | 1/2011 | A45F 3/20 |

OTHER PUBLICATIONS

International Search Report and Written Opinion received for PCT Patent Application No. PCT/US2016/035778, dated Apr. 10, 2017, 16 pages.

* cited by examiner

HAND-CARRIED HYDRATION BLADDER

CROSS-REFERENCE TO RELATED APPLICATION

This application is a continuation of International Application No. PCT/US2016/035778, with an international filing date of Jun. 3, 2016, which is incorporated by reference herein in its entirety.

TECHNICAL FIELD

The present invention relates to hand-carried hydration containers. More specifically, the present invention relates to hand-carried hydration bladders that include reinforcement members to inhibit bladder and liquid movement while performing vigorous activities.

BACKGROUND

Hand-carried hydration containers provide users with liquids (for example, water) during various types of activities, such as running, hiking, and the like. Hand-carried hydration bladders have a relatively high degree of flexibility to conform to the shape of the user's hand. This property makes hand-carried hydration bladders more comfortable than other relatively rigid hand-carried hydration containers. However, this property also facilitates a significant amount of movement of hand-carried hydration bladders and carried liquids during vigorous activities, such as running. This movement can be distracting, and some users grip hand-carried hydration bladders tightly to inhibit the movement, which can be physically tiring.

SUMMARY

In a first example, a hydration bladder according to the present disclosure includes a flexible body having a first stiffness; a port coupled to the flexible body; a liquid chamber formed by the flexible body, the liquid chamber configured to carry a liquid therein and in communication with the port; and a reinforcement member coupled to the flexible body, the reinforcement member having a second stiffness, the second stiffness being greater than the first stiffness, the reinforcement member including: a first width; a second width greater than the first width; and a third width disposed on an opposite of the second width than the first width, the third width being less than the second width.

In a second example, the first width, the second width, and the third width of the first example are each local maximum widths.

In a third example, the reinforcement member of any of the preceding examples further includes: a first intermediate width disposed between the first width and the second width, the first intermediate width being less than the first width; and a second intermediate width disposed between the second width and the third width, the second intermediate width being less than the third width.

In a fourth example, the first width, the second width, and the third width of any of the preceding examples are each local maximum widths, and the first intermediate width and the second intermediate width are each local minimum widths.

In a fifth example, the hydration bladder of any of the preceding examples further includes a harness coupled to the flexible body, the harness configured to engage a hand of a user.

In a sixth example, the flexible body of any of the preceding examples is elongated along a longitudinal axis thereof, and the reinforcement member and the harness are substantially angularly aligned about the longitudinal axis.

In a seventh example, the harness of any of the preceding examples includes an adjustable loop.

In an eighth example, the harness of any of the preceding examples is detachably coupled to the flexible body.

In a ninth example, the flexible body of any of the preceding examples is elongated along a longitudinal axis thereof, the reinforcement member is elongated along a length direction extending between the first width and the third width, and the length direction is substantially parallel to the longitudinal axis.

In a tenth example, a hydration bladder according to the present disclosure includes a flexible body elongated in a longitudinal axis thereof, and the flexible body having a first stiffness; a port coupled to the flexible body; a liquid chamber formed by the flexible body, the liquid chamber configured to carry a liquid therein and in communication with the port; and a reinforcement member coupled to the flexible body, the reinforcement member having a second stiffness, the second stiffness being greater than the first stiffness, and the reinforcement member further including: a length in a length direction substantially parallel to the longitudinal axis; and a global maximum width in a width direction substantially perpendicular to the length direction, the global maximum width being from 14 percent to 44 percent of the length.

In an eleventh example, the global maximum width of the tenth example is from 19 percent to 39 percent of the length.

In a twelfth example, the global maximum width of any of the preceding examples is from 24 percent to 34 percent of the length.

In a thirteenth example, the hydration bladder of any of the preceding examples further includes a harness coupled to the flexible body, the harness configured to engage a hand of a user.

In a fourteenth example, the reinforcement member and the harness of any of the preceding examples are substantially angularly aligned about the longitudinal axis.

In a fifteenth example, the harness of any of the preceding examples includes an adjustable loop.

In a sixteenth example, the harness of any of the preceding examples is detachably coupled to the flexible body.

In a seventeenth example, a hydration bladder according to the present disclosure includes a flexible body; a port coupled to the flexible body; a liquid chamber formed by the flexible body, the liquid chamber configured to carry a liquid therein and in communication with the port; and a harness coupled to the flexible body, the harness including a loop configured to engage a hand of a user.

In an eighteenth example, the loop according to the seventeenth example is an adjustable-size loop.

In a nineteenth example, the harness of any of the preceding examples is detachably coupled to the flexible body.

In a twentieth example, the flexible body of any of the preceding examples has a first stiffness, and further including a reinforcement member coupled to the flexible body, the reinforcement member has a second stiffness, the second stiffness being greater than the first stiffness.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
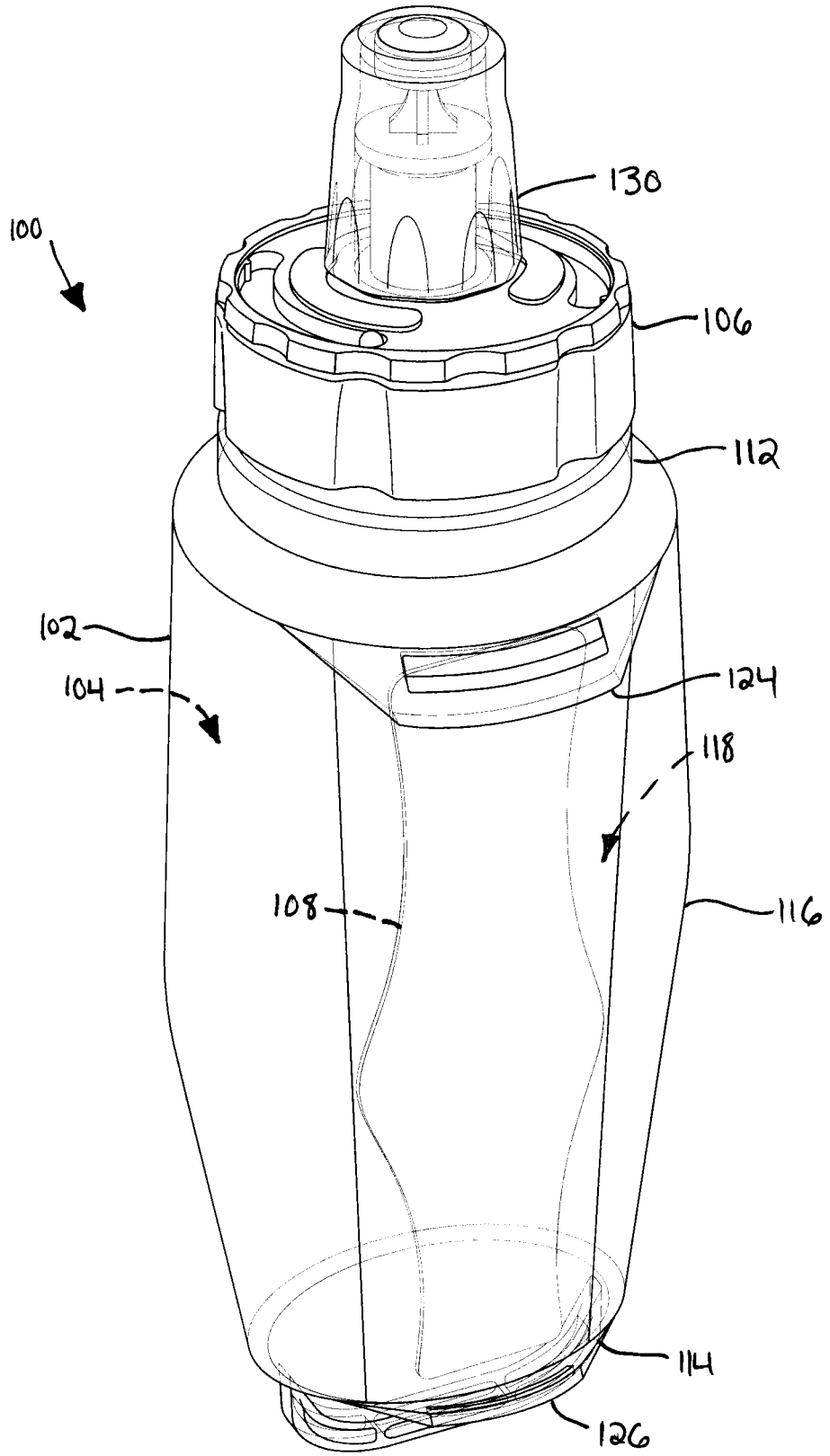
FIG. 1 is a perspective view of a hydration bladder in an unfilled state, according to some embodiments of the present disclosure.

It should be understood that the drawings are intended facilitate understanding of exemplary embodiments of the present invention are not necessarily to scale.

DETAILED DESCRIPTION

FIGS. 1-7 and 15-21 illustrate a hydration bladder 100, which may also be referred to as a "flask", according to some embodiments of the present disclosure. FIGS. 1-7 illustrate the hydration bladder 100 being empty or in an unfilled state, and FIGS. 15-21 illustrate the hydration bladder 100 carrying a liquid (for example, water) or in a filled state. Generally, the hydration bladder 100 includes a collapsible and flexible body 102 that forms an internal liquid chamber 104. The liquid chamber 104 receives and carries the liquid therein. The flexible body 102 is coupled to a port 106, which is in communication with the liquid chamber 104 to deliver the liquid thereto and receive the liquid therefrom. The flexible body 102 is also coupled to a reinforcement member 108 that is disposed adjacent the liquid chamber 104. The reinforcement member 108 reduces movement of the hydration bladder 100 and the liquid carried in the liquid chamber 104 during vigorous activities, such as running and the like. The above and additional aspects of the hydration bladder 100 are described in further detail below.

FIGS. 8-14 and 22-28 illustrate a hydration bladder 800 according to some embodiments of the present disclosure. FIGS. 8-14 illustrate the hydration bladder 800 being empty or in an unfilled state, and FIGS. 22-28 illustrate the hydration bladder 800 carrying a liquid or in a filled state. The hydration bladder 800 includes the same features as the hydration bladder 100. That is, the hydration bladder 800 includes the flexible body 102, the internal liquid chamber 104, the port 106, and the reinforcement member 108 (obscured in FIGS. 8-14 and 22-28). In addition, the hydration bladder 800 includes a hand harness 802 that is detachably coupled to the flexible body 102 and configured to engage a hand of a user. The hydration bladder 800 further includes a jacket 804 that partially surrounds the flexible body 102. The hand harness 802 and/or the jacket 804 facilitate carrying the hydration bladder 800 in a relatively comfortable manner. The above and additional aspects of the hydration bladder 800 are described in further detail below.

Returning now to FIGS. 1-7 and 15-21, the flexible body 102 may be formed of various materials, such as one or more polymers (for example, thermoplastic polyurethane (TPU), thermoplastic elastomers (TPE), polyethylene-vinyl acetate (PEVA), or polyethylene terephthalate (PET)). In some embodiments, the flexible body 102 is formed of a translucent material. In some embodiments, such a material has a relatively low elastic modulus to facilitate flexibility of the body 102. The elastic modulus may be, for example, less than 800 MPa. The flexible body 102 may generally have a thickness of about 0.2 mm to 0.5 mm, although the thickness of the flexible body 102 may vary in different sections or portions of the body 102, such as the portions described below. In some embodiments, the elastic modulus and one or more dimensions of the flexible body 102 may provide the flexible body 102 with a relatively low stiffness (for example, bending stiffness, flexural rigidity, or column strength). The stiffness may be, for example, less than 800 MPa.

The flexible body 102 may be sized to provide the liquid chamber 104 with any of various volume capacities. For example, the liquid chamber 104 may have a volume capacity of 355 milliliters, a volume capacity from 1 fl. oz. to 34 fl. oz. (from 30 milliliters to 1 liter), or the like.

In some embodiments, the flexible body 102 is elongated along a longitudinal axis 110 (see FIGS. 16-19) that extends between an opening portion 112 and an opposite end portion 114. The flexible body 102 further includes an elongated portion 116 that is disposed between the opening portion 112 and the opposite end portion 114. The elongated portion 116 extends along the longitudinal axis 110.

In some embodiments, the elongated portion 116 of the flexible body 102 couples to the reinforcement member 108. For example, the elongated portion 116 of the flexible body 102 may include a separate reinforcement member chamber 118 that receives the reinforcement member 108. The reinforcement member chamber 118 may be formed by an outer flexible wall 120 and an inner flexible wall 122 of the flexible body 102 (see FIGS. 3, 4, 18, and 19) that are coupled to each other (for example, via adhesive bonding, heat bonding, or the like). In some embodiments and as shown in the drawings, the reinforcement member chamber 118 may be closed to inhibit removal of the reinforcement member 108 therefrom. In other embodiments, the reinforcement member chamber 118 may include one or more openings (not shown) to facilitate removal of the reinforcement member 108 therefrom, which may facilitate storing the hydration bladder 100 in a relatively compact shape. In other embodiments, the flexible body 102 lacks a reinforcement member chamber 118, and the reinforcement member 108 could be coupled to the flexible body 102 in other manners. For example, the reinforcement member 108 could be coupled to the outer surface or the inner surface of the flexible body 102 via adhesive bonding.

In some embodiments, the flexible body 102 includes a first eyelet 124 and a second eyelet 126 that are coupled to the opening portion 112 and the opposite end portion 114, respectively. The eyelets 124, 126 also couple to the hand harness 802 (see FIGS. 8-14 and 22-28). In some embodiments, the eyelets 124, 126 (and therefore the harness 802) and the reinforcement member 108 are substantially angularly aligned about the longitudinal axis 110 of the flexible body 102 (that is, aligned within ±10 degrees).

The port 106 includes an opening 128 (see FIG. 2) in communication with the liquid chamber 104. The opening 128 is formed by the opening portion 112 of the flexible body 102. The port 106 also includes a mouthpiece 130 that couples to the opening portion 112 and is in fluid communication with the opening 128. The mouthpiece 130 may be detachably coupled to the opening portion 112, for example, via threaded surfaces (not shown). In some embodiments, the mouthpiece 130 may be selectively opened or closed to permit or inhibit, respectively, delivery of the liquid from hydration bladder 100. In some embodiments, the mouthpiece 130 may be selectively locked to inhibit the mouthpiece 130 from being opened.

In other embodiments, the hydration bladder 100 may include multiple ports that facilitate delivering a liquid to and receiving the liquid from the liquid chamber 104. As a specific example, the hydration bladder 100 may include an inlet port (not shown) to deliver liquid to the liquid chamber 104 and a separate outlet port (not shown) to receive the liquid from the liquid chamber 104.

Figure 29:
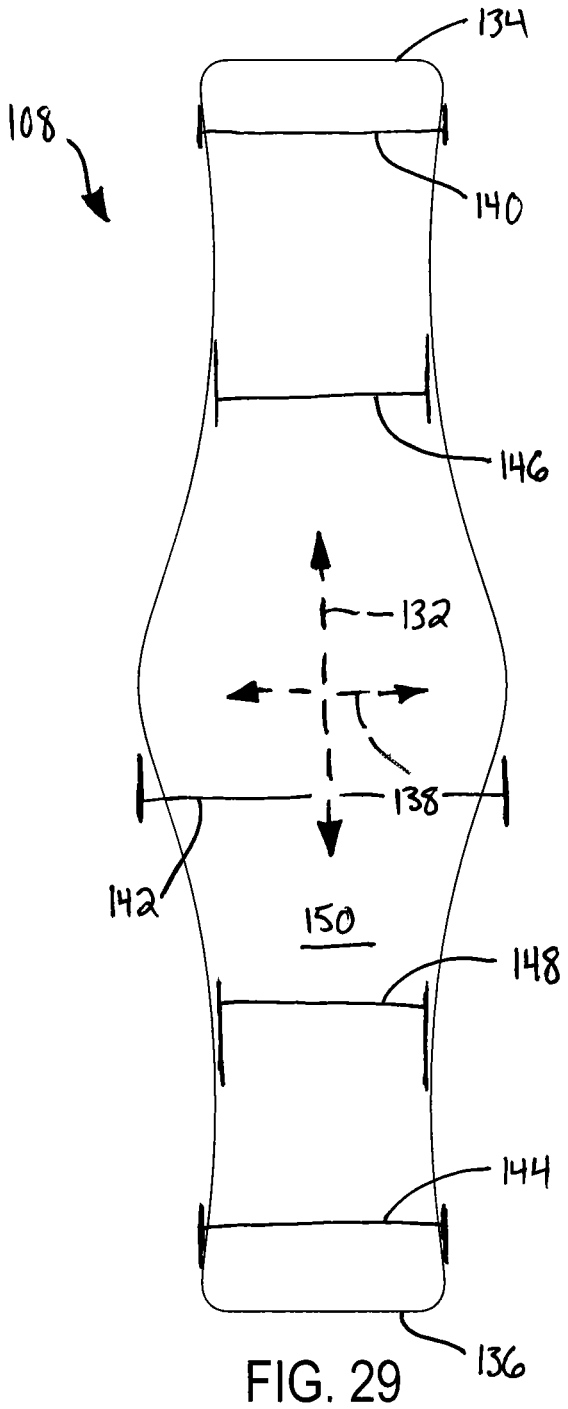
FIG. 29 is a front view of a reinforcement member of the hydration bladders of FIGS. 1 and 8.

The reinforcement member 108, which may also be referred to as a "spine", is illustrated separately in FIG. 29. The reinforcement member 108 may be formed of various materials, such as one or more polymers (for example, polypropylene (PP), low-density polyethylene (LDPE), high-density polyethylene (HDPE), TPU, Nylon, or acrylonitrile butadiene styrene (ABS)). In some embodiments, such a material has a relatively high elastic modulus to provide structural support 106. Stated another way, the flexible body 102 includes a material having a first elastic modulus, the reinforcement member 108 includes a material having a second elastic modulus, and the second elastic modulus is greater than the first elastic modulus. The elastic modulus of the reinforcement member 108 may be, for example, more than 800 MPa. In some embodiments, the elastic modulus and one or more dimensions of the reinforcement member 108 may provide the reinforcement member 108 with a relatively high stiffness (for example, bending stiffness, flexural rigidity, or column strength). Stated another way, the flexible body 102 has a first stiffness, the reinforcement member 108 has a second stiffness, and the second stiffness is greater than the first stiffness. The stiffness may be, for example, more than 800 MPa. In some embodiments, the relatively high stiffness of the reinforcement member 108 reduces movement of the hydration bladder 100 and the carried liquid during vigorous activities.

The reinforcement member 108 may have various shapes and/or sizes. In some embodiments, the reinforcement member 108 is (1) elongated along a length direction 132 that extends between a first end 134 and a second end 136; (2) relatively short in a width direction 138 that is substantially perpendicular to the length direction 132 (that is, perpendicular within ±10 degrees); and (3) relatively thin in a thickness direction that is substantially perpendicular to the length direction 132 and the width direction 138 (that is, extending into the page, and perpendicular to the length direction 132 and the width direction 138 within ±10 degrees). In some embodiments, the reinforcement member 108 is symmetric over a plane extending in the thickness direction and intersecting with the length direction 132. In some embodiments, the reinforcement member 108 is symmetric over a plane extending in the thickness direction and intersecting with the width direction 138. In some embodiments, the length direction 132 is substantially parallel to the longitudinal axis 110 of the flexible body 102 (that is, parallel within ±10 degrees), and the width direction 138 that is substantially perpendicular to the longitudinal axis 110 of the flexible body 102 (that is, perpendicular within ±10 degrees).

In some embodiments and as shown in the figures, the reinforcement member 108 has a shape that is appropriate for being comfortably received in the palm of the user's hand. Specifically, such a shape includes a first width 140, a second width 142 that is greater than the first width 140, and a third width 144 that is less than the second width 142 and is disposed on an opposite of the second width 142 relative to the first width 140. In some embodiments, the first width 140, the second width 142, and the third width 144 are each local maximum widths of the reinforcement member 108. In some embodiments, the second width 142 is the global maximum width of the reinforcement member 108. In some embodiments, the second width 142 is from 14 percent to 44 percent of the length of the reinforcement member 108, from 19 percent to 39 percent of the length of the reinforcement member 108, or from 24 percent to 34 percent of the length of the reinforcement member 108. In some embodiments, the first width 140 is from 55 percent to 85 percent of the second width 142, from 60 percent to 80 percent of the second width 142, or from 65 percent to 75 percent of the second width 142. In some embodiments, the third width 144 is from 55 percent to 85 percent of the second width 142, from 60 percent to 80 percent of the second width 142, or from 65 percent to 75 percent of the second width 142.

In some embodiments and as shown in the figures, the reinforcement member 108 further includes a first intermediate width 146 and a second intermediate width 148. The first intermediate width 146 is disposed between the first width 140 and the second width 142. The first intermediate width 146 is less than the first width 140. In some embodiments, the first intermediate width 146 is from 45 percent to 75 percent of the second width 142, from 50 percent to 70 percent of the second width 142, or from 55 percent to 65 percent of the second width 142. In some embodiments, the first intermediate width 146 is a local minimum width. The second intermediate width 148 is disposed between the second width 142 and the third width 144. The second intermediate width 148 is less than the third width 144. In some embodiments, the second intermediate width 148 is from 45 percent to 75 percent of the second width 142, from 50 percent to 70 percent of the second width 142, or from 55 percent to 65 percent of the second width 142. In some embodiments, the second intermediate width 148 is a local minimum width.

In some embodiments, the reinforcement member 108 has other shapes. For example, the reinforcement member 108 may have a rectangular shape (not shown), an oval shape (not shown), or the like. In some embodiments, the reinforcement member 108 has a monolithic structure. In other embodiments, the reinforcement member 108 has a multiple-component structure (not shown). In such embodiments, the components of the reinforcement member 108 may be detachably coupled or telescopically coupled to each other, which may facilitate storing the hydration bladder 100 in a relatively compact shape.

Figure 2:
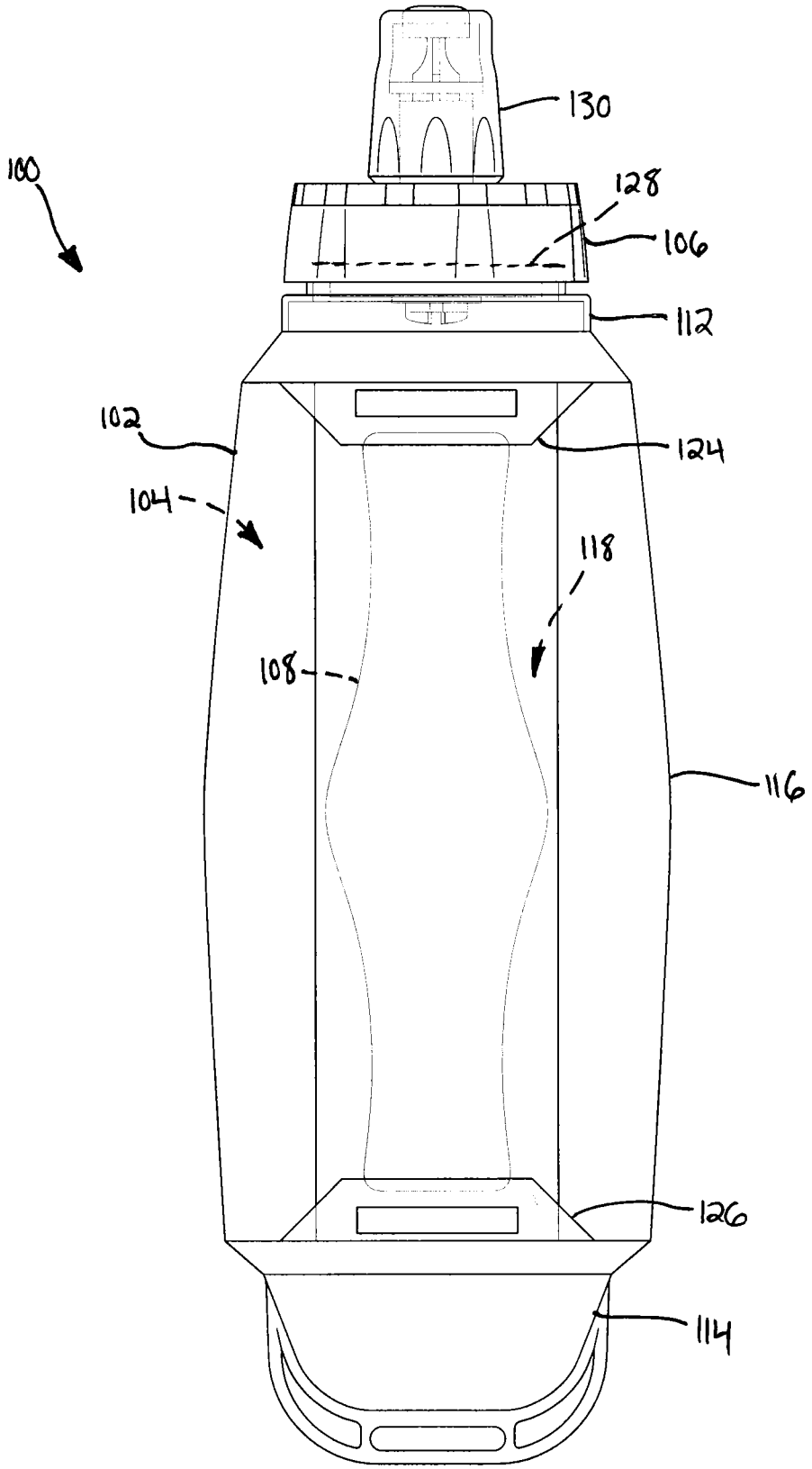
FIG. 2 is a front view of the hydration bladder of FIG. 1.
Figure 3:
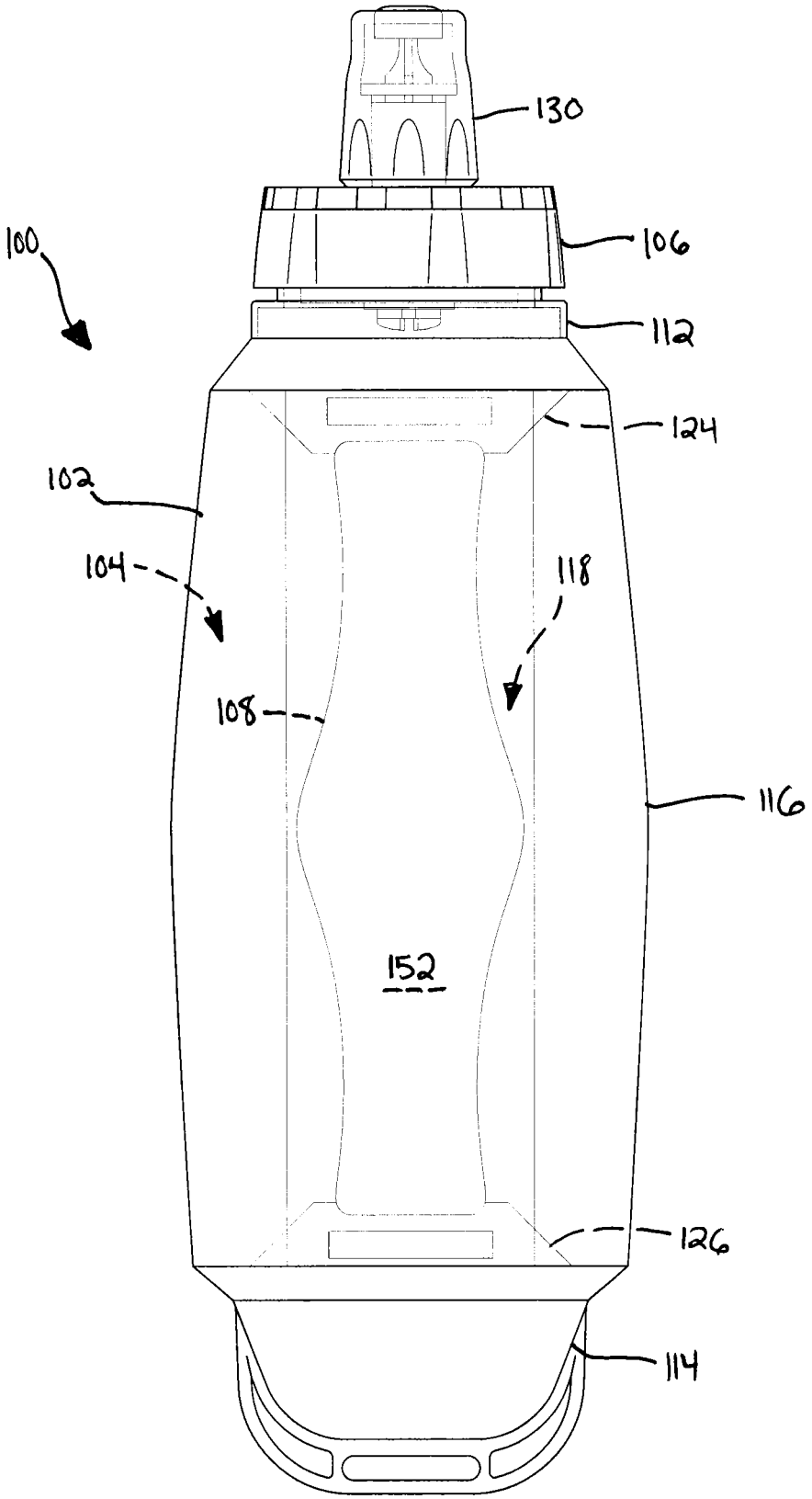
FIG. 3 is a back view of the hydration bladder of FIG. 1.
Figure 4:
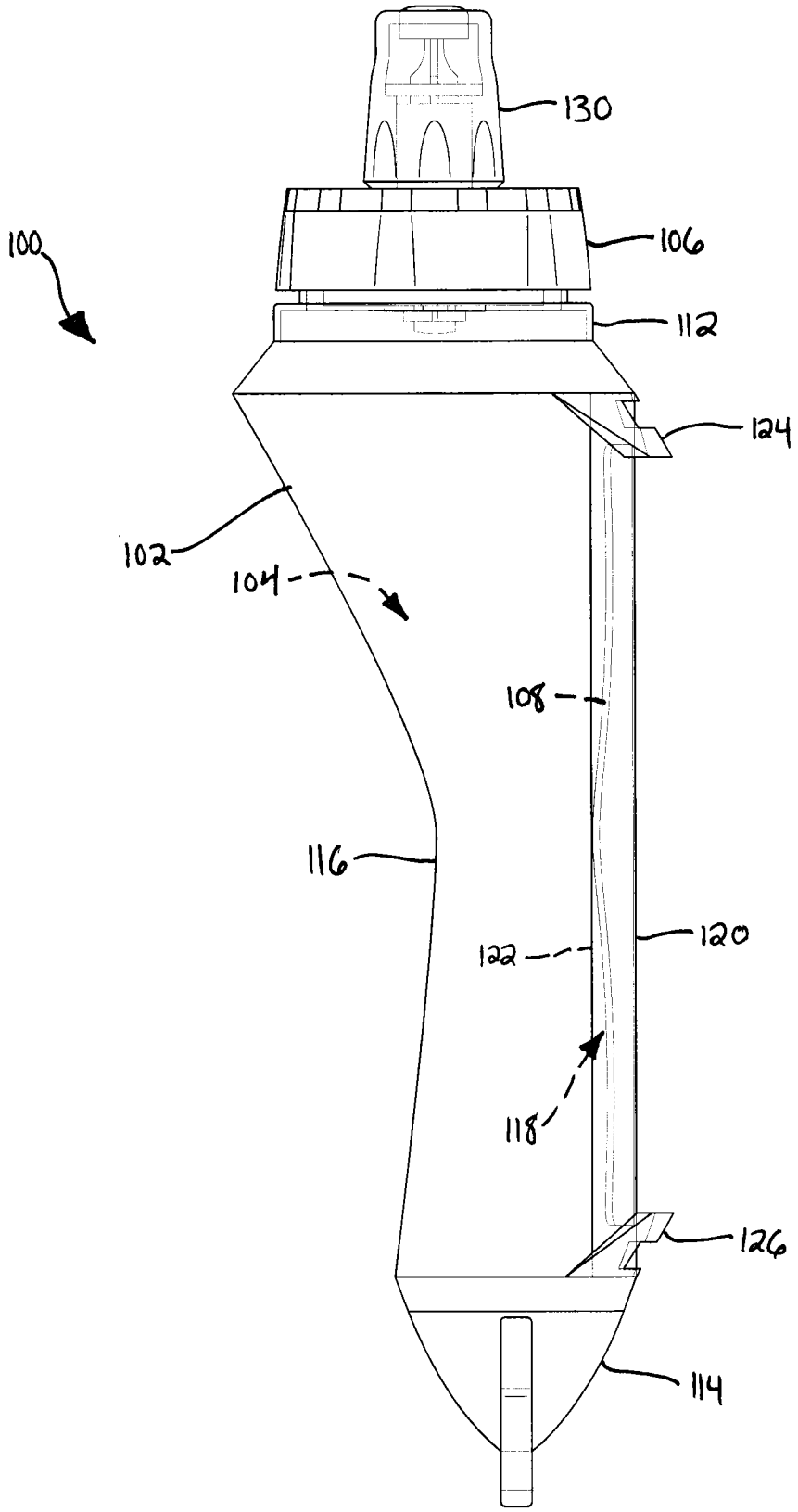
FIG. 4 is a left side view of the hydration bladder of FIG. 1.
Figure 5:
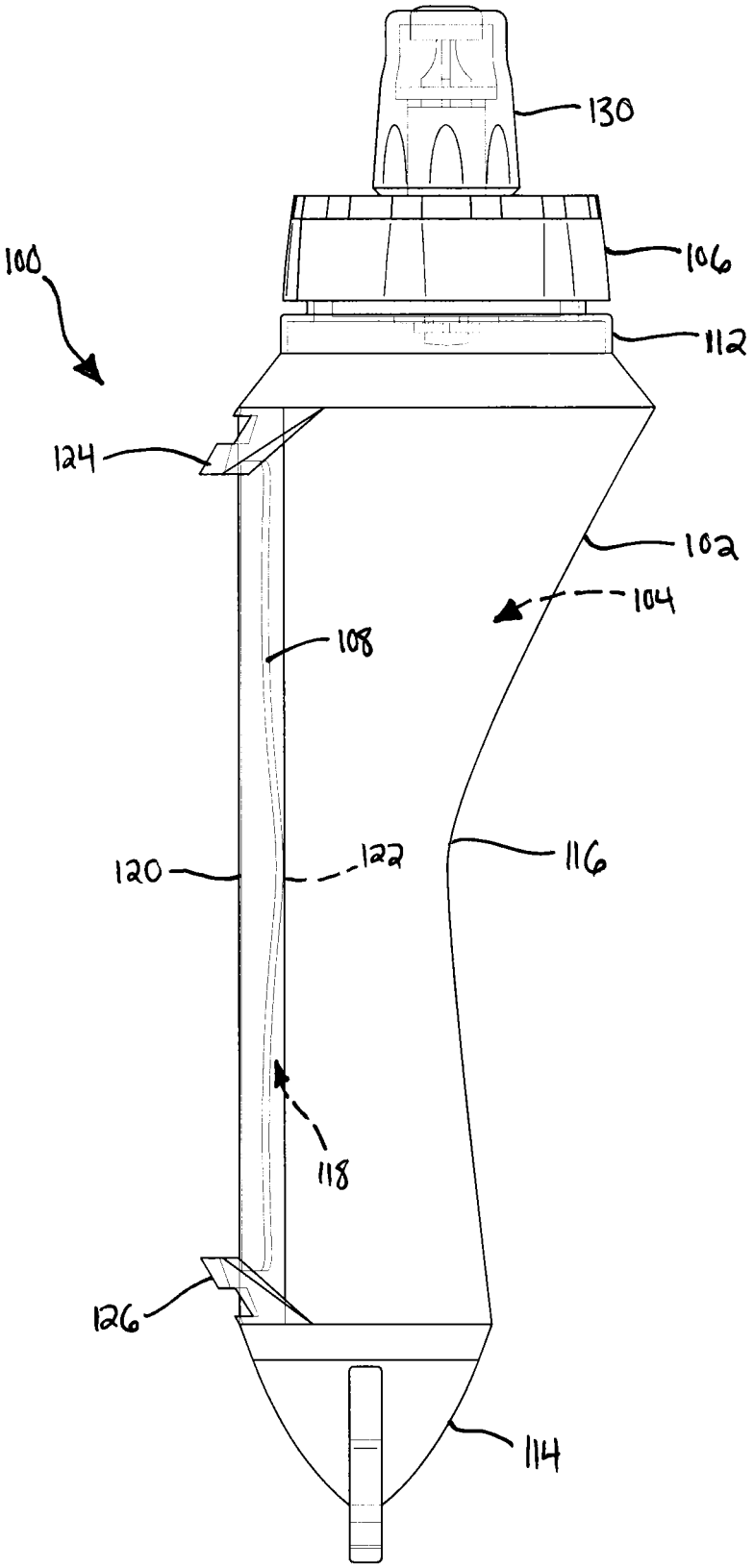
FIG. 5 is a right side view of the hydration bladder of FIG. 1.
Figure 6:
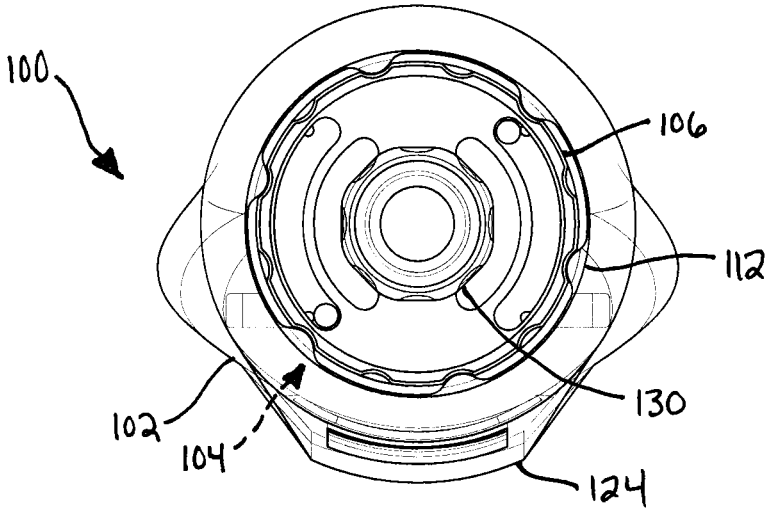
FIG. 6 is a top view of the hydration bladder of FIG. 1.
Figure 7:
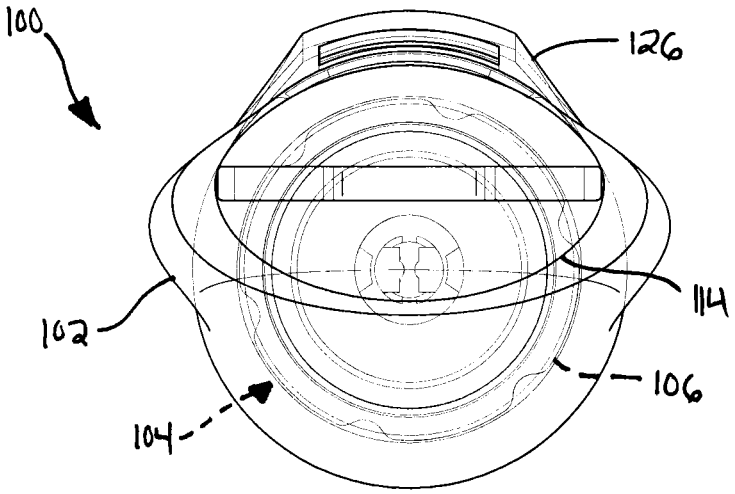
FIG. 7 is a bottom view of the hydration bladder of FIG. 1.
Figure 8:
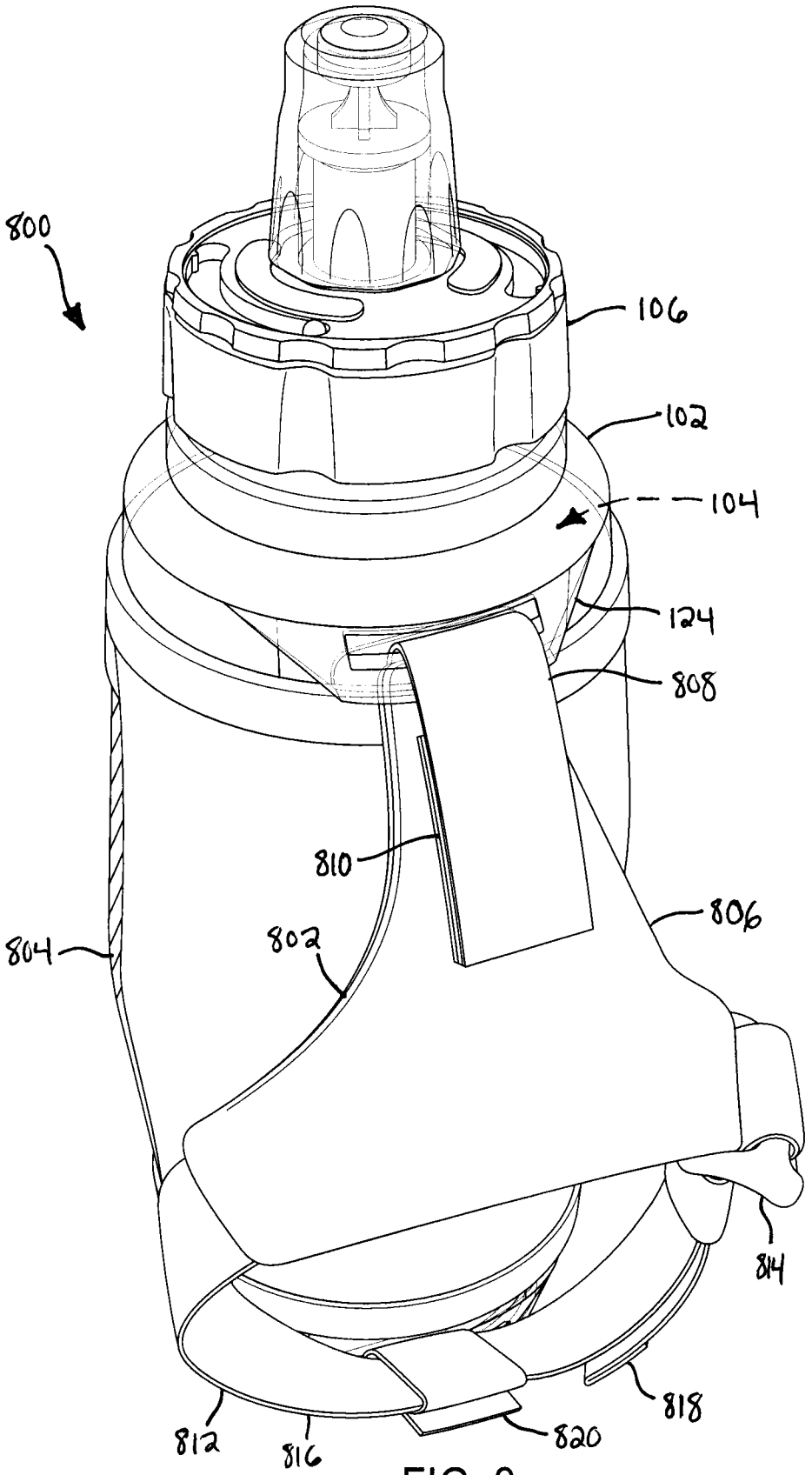
FIG. 8 is a perspective view of a hydration bladder in an unfilled state, according to some embodiments of the present disclosure.
Figure 9:
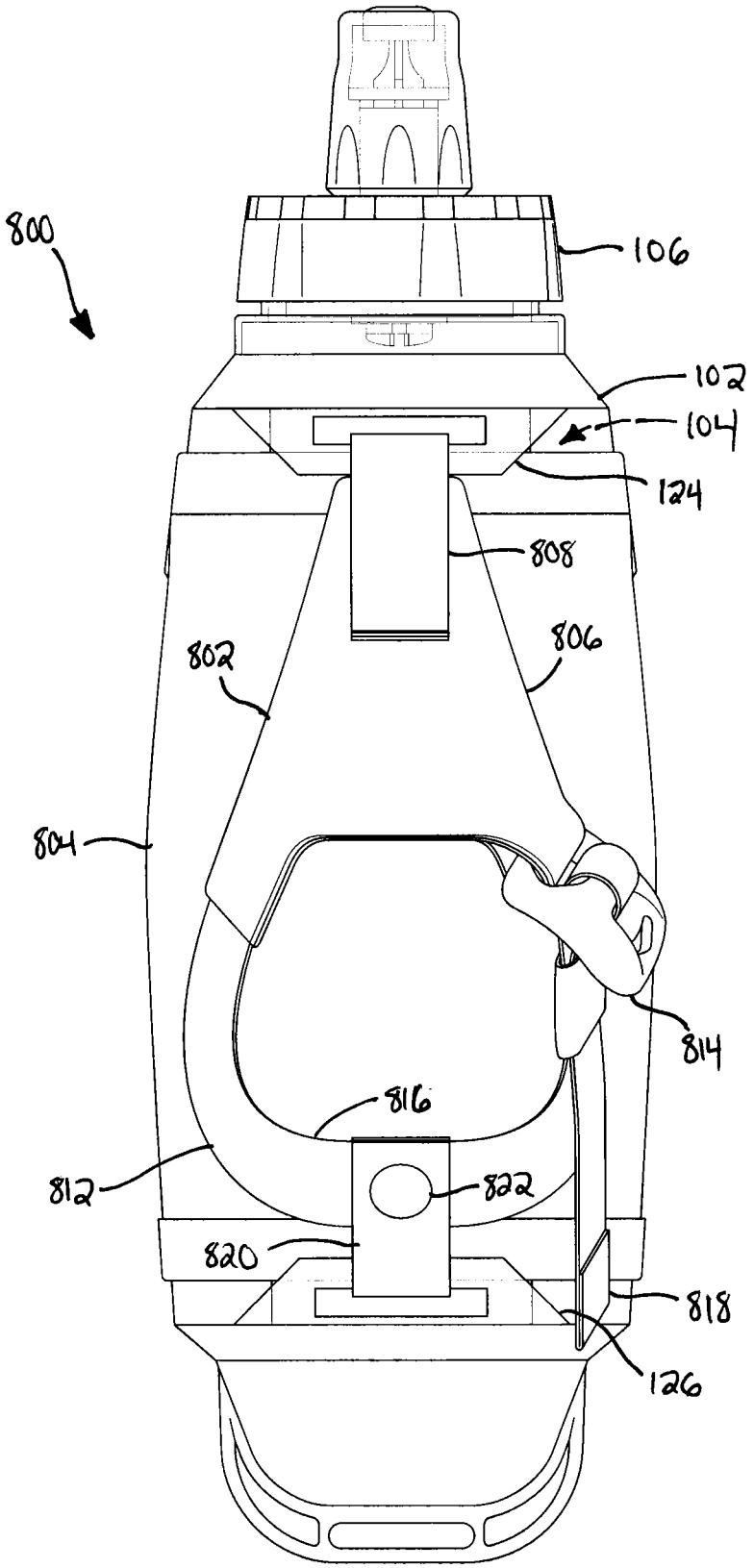
FIG. 9 is a front view of the hydration bladder of FIG. 8.
Figure 10:
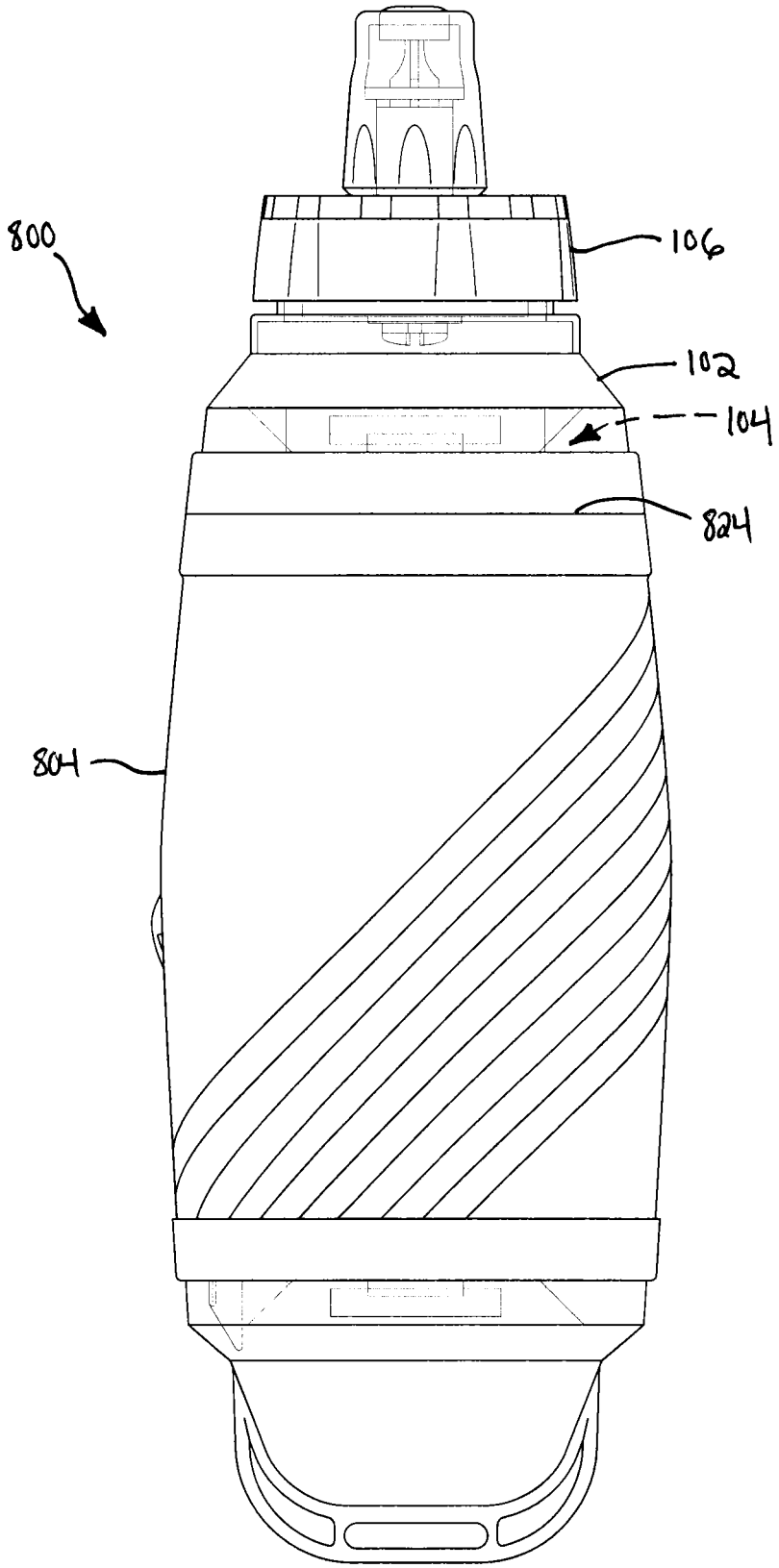
FIG. 10 is a back view of the hydration bladder of FIG. 8.
Figure 11:
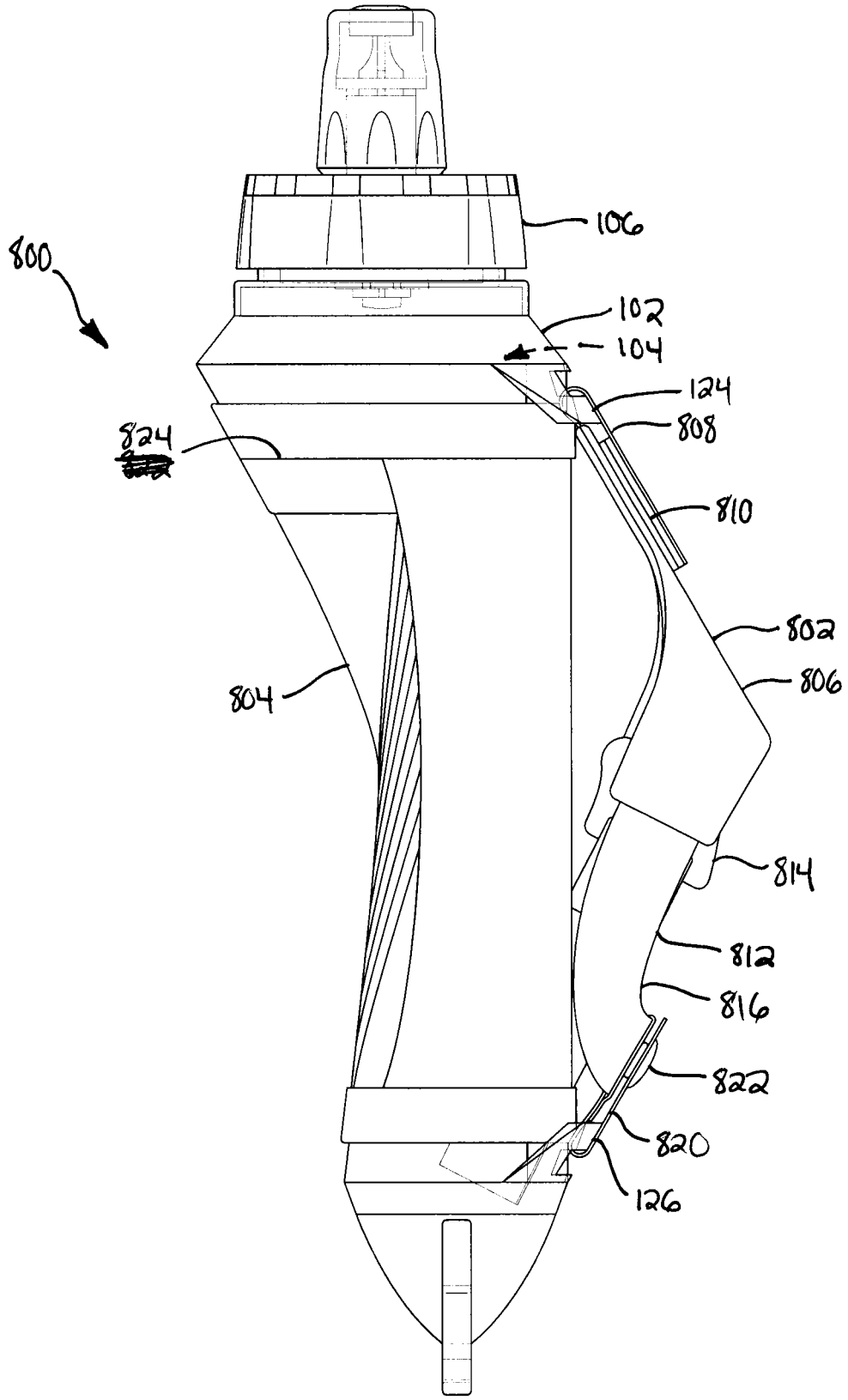
FIG. 11 is a left side view of the hydration bladder of FIG. 8.
Figure 12:
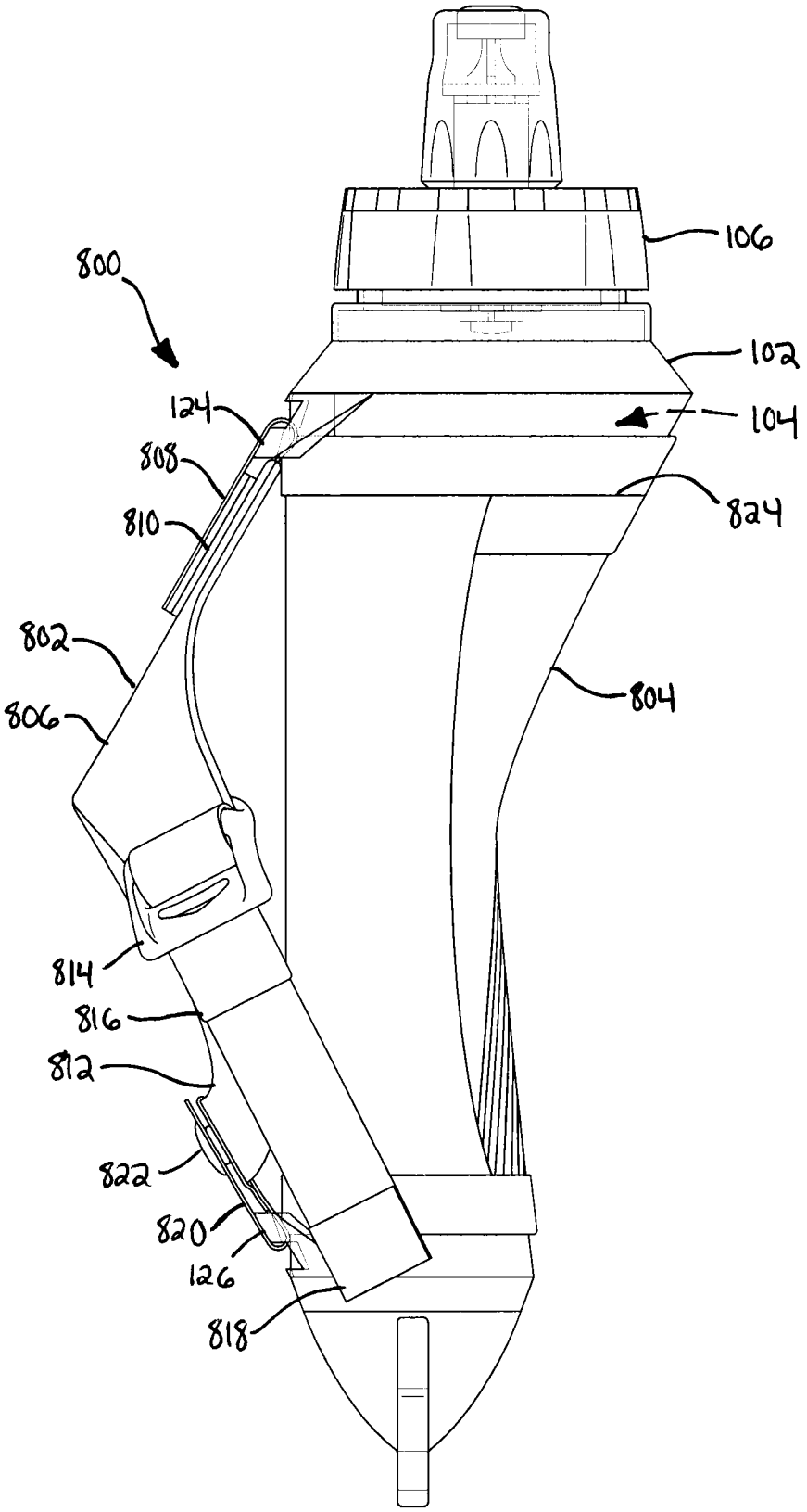
FIG. 12 is a right side view of the hydration bladder of FIG. 8.
Figure 13:
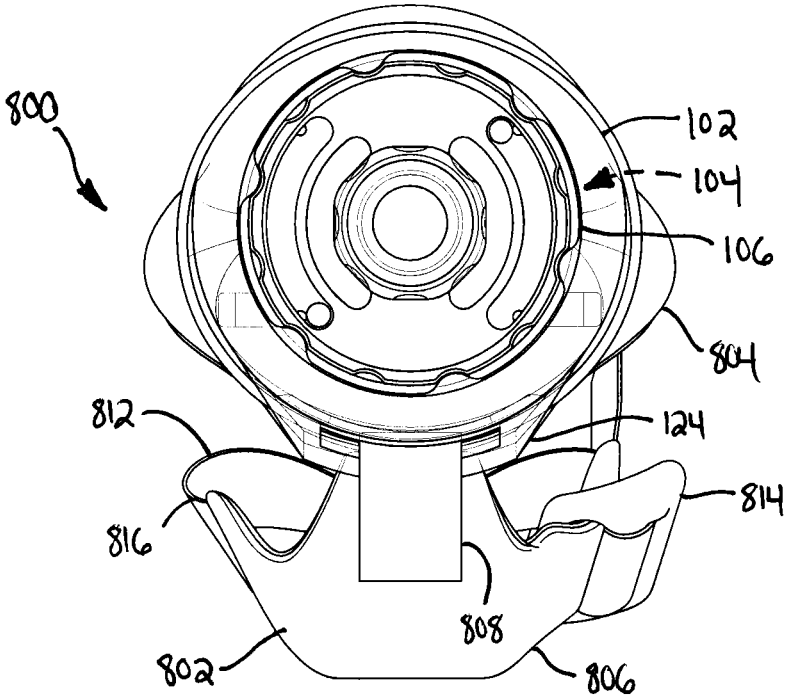
FIG. 13 is a top view of the hydration bladder of FIG. 8.
Figure 14:
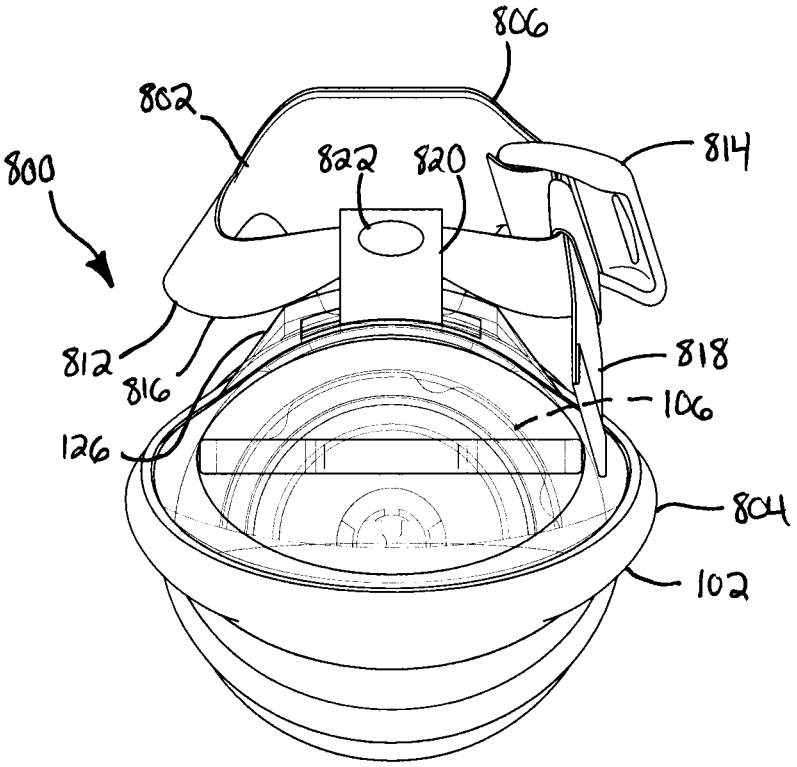
FIG. 14 is a bottom view of the hydration bladder of FIG. 8.
Figure 15:
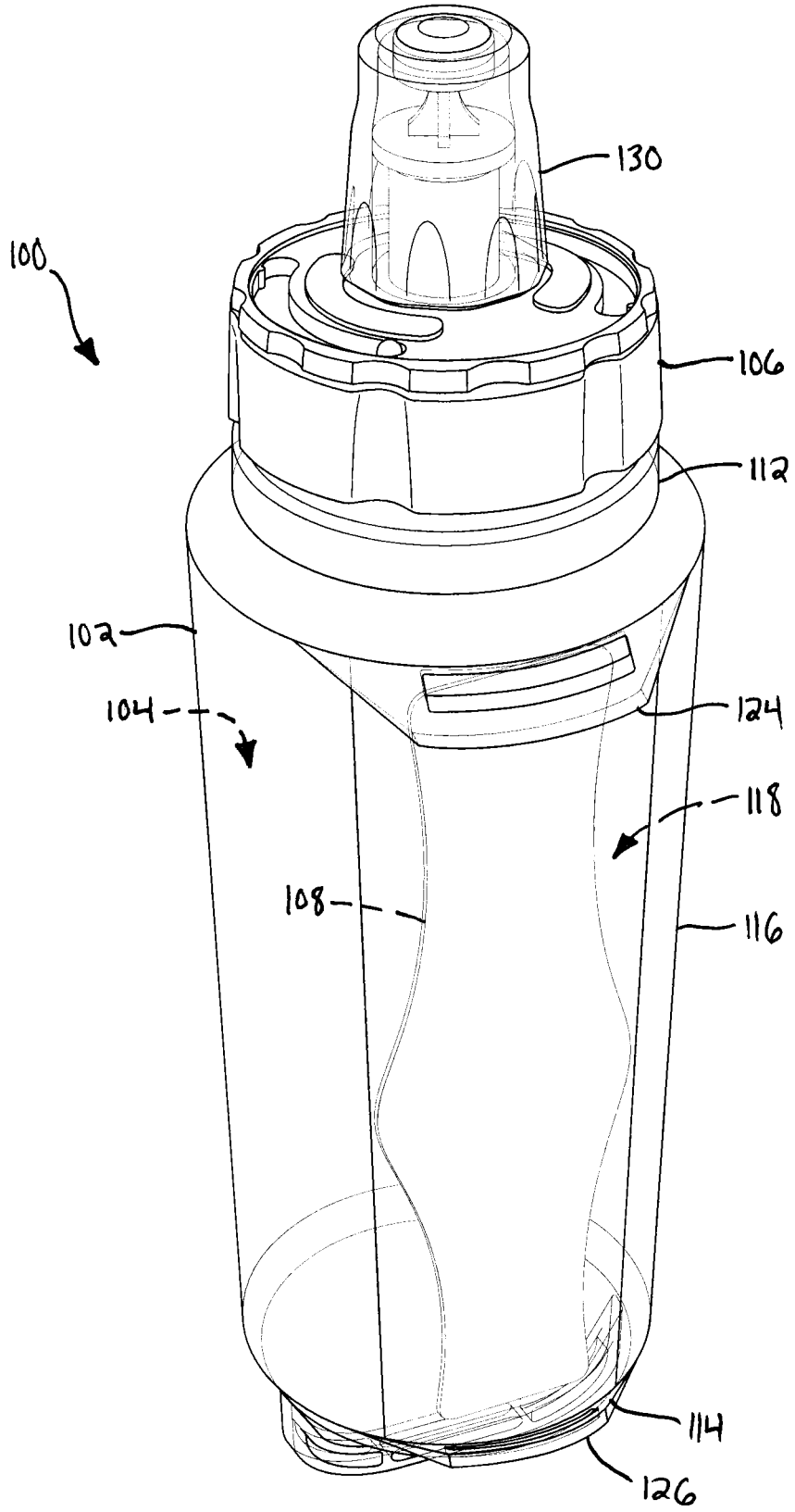
FIG. 15 is a perspective view of the hydration bladder of FIG. 1 in a filled state.
Figure 16:
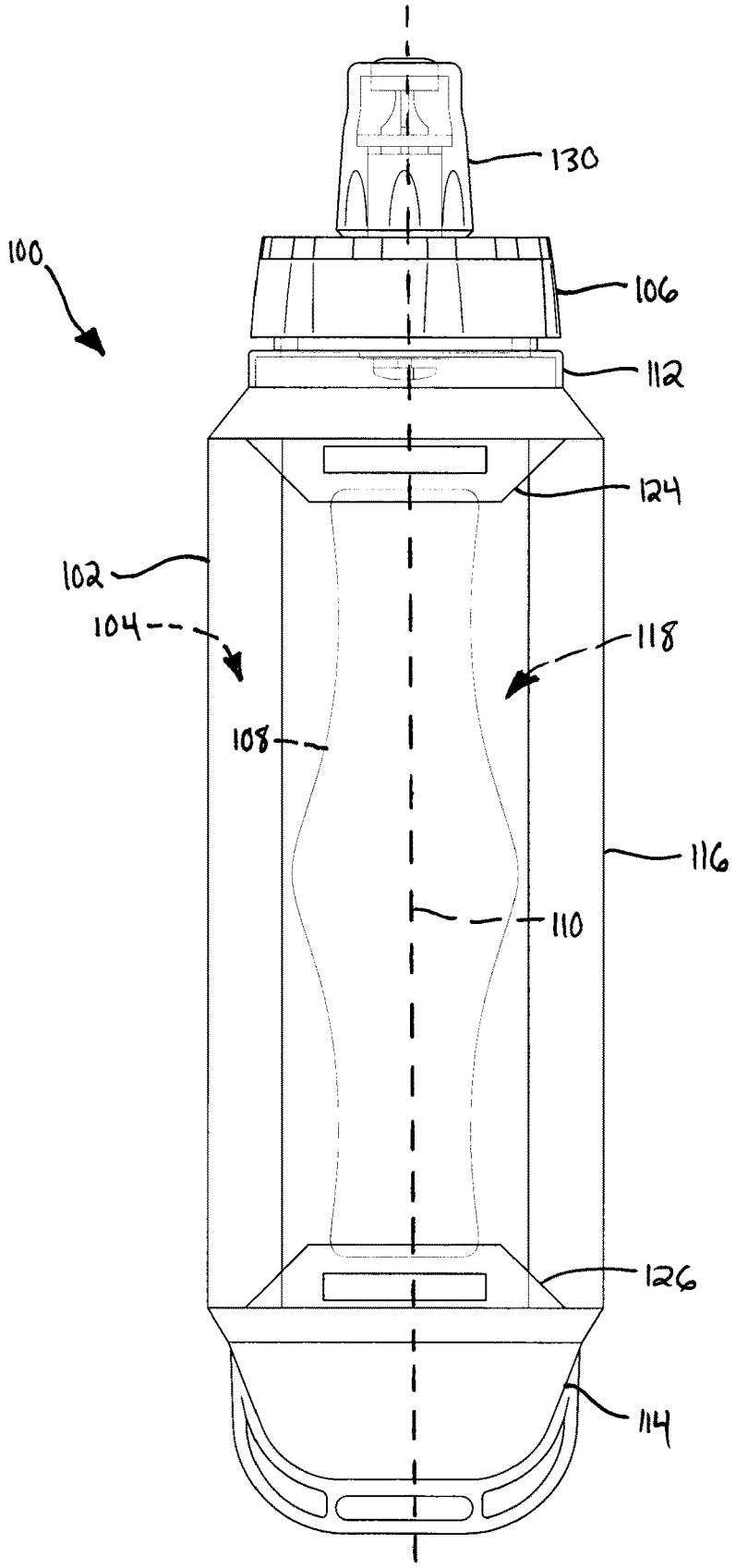
FIG. 16 is a front view of the hydration bladder of FIG. 15.
Figure 17:
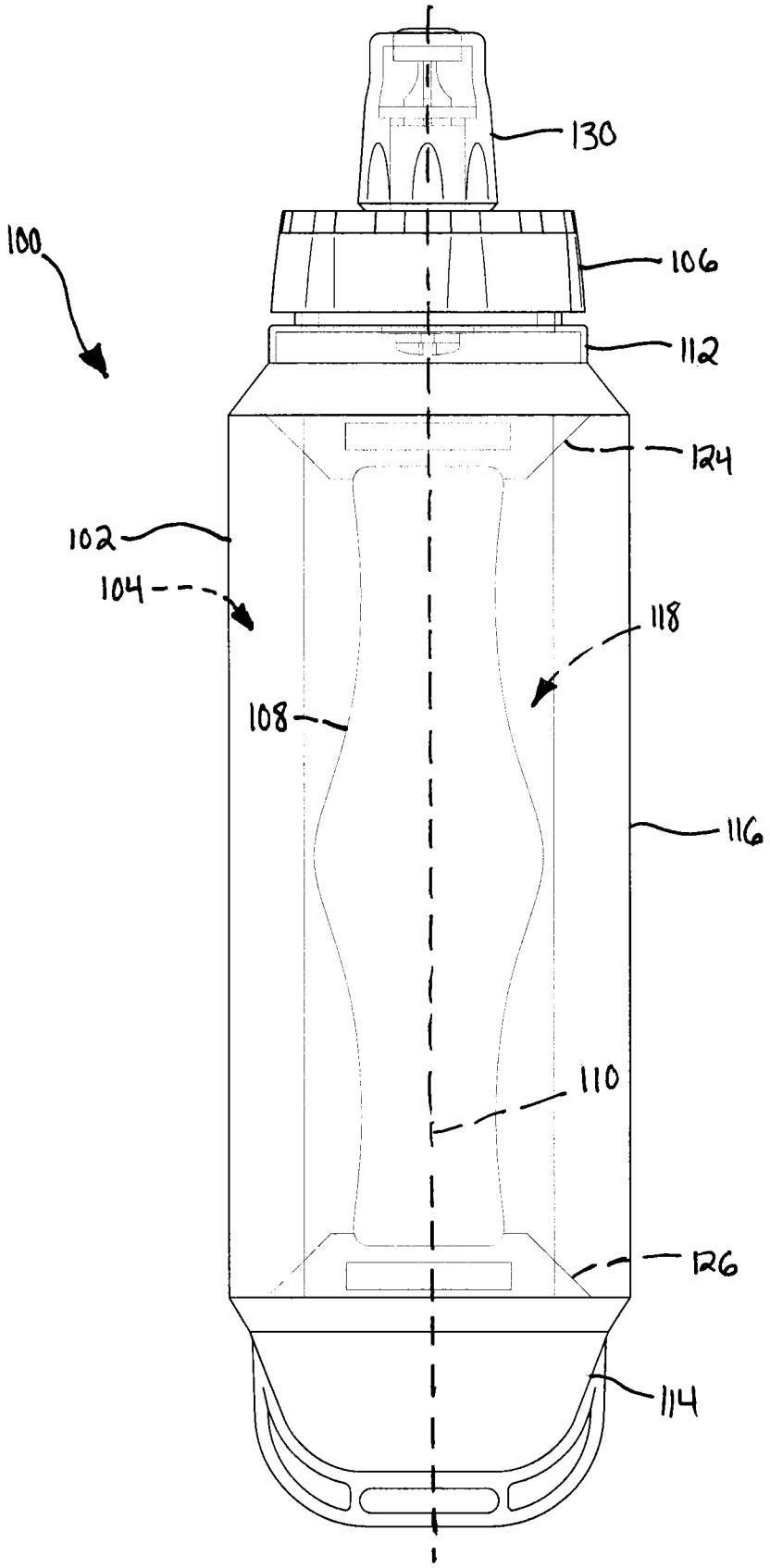
FIG. 17 is a back view of the hydration bladder of FIG. 15.
Figure 18:
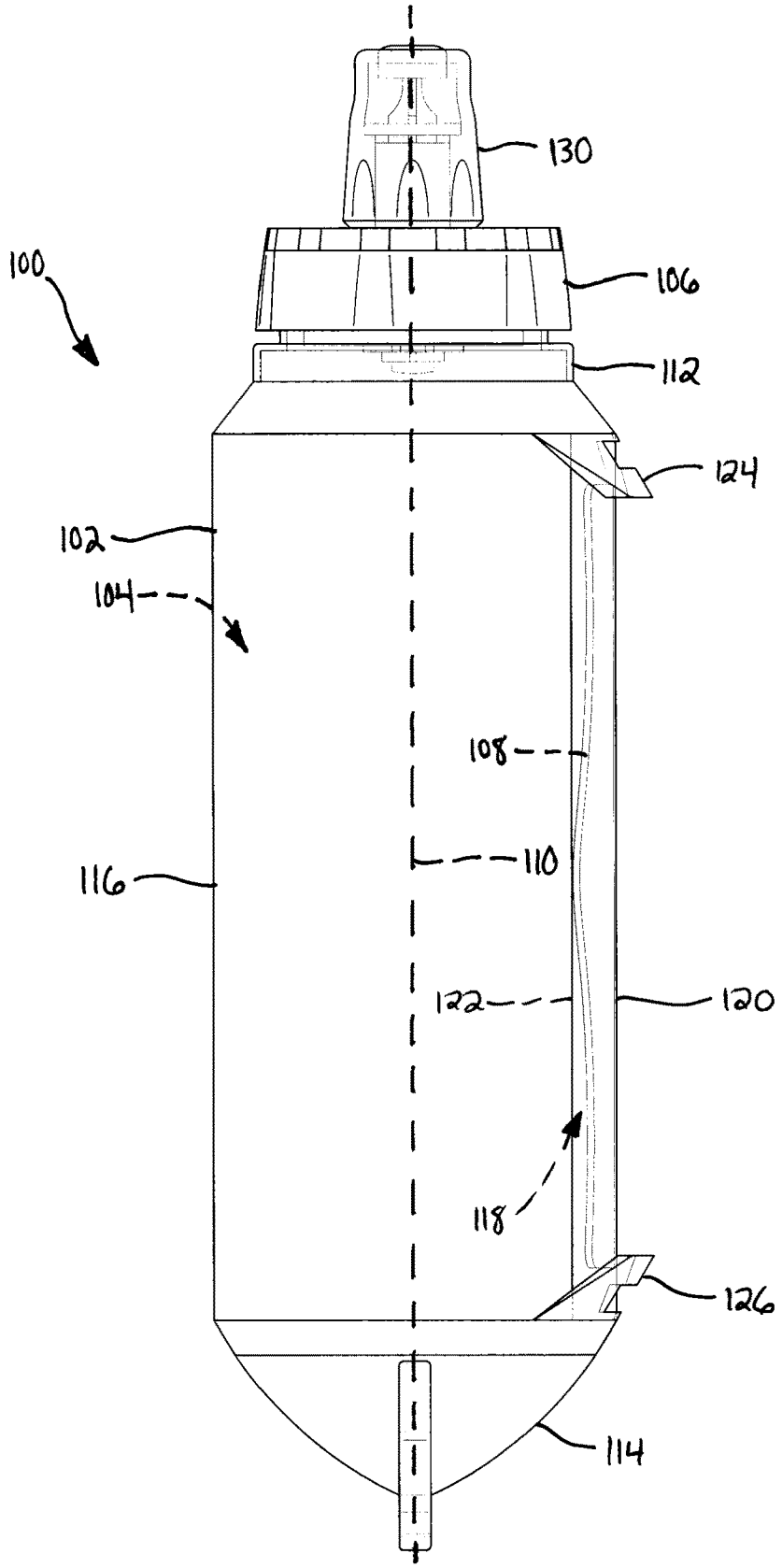
FIG. 18 is a left side view of the hydration bladder of FIG. 15.
Figure 19:
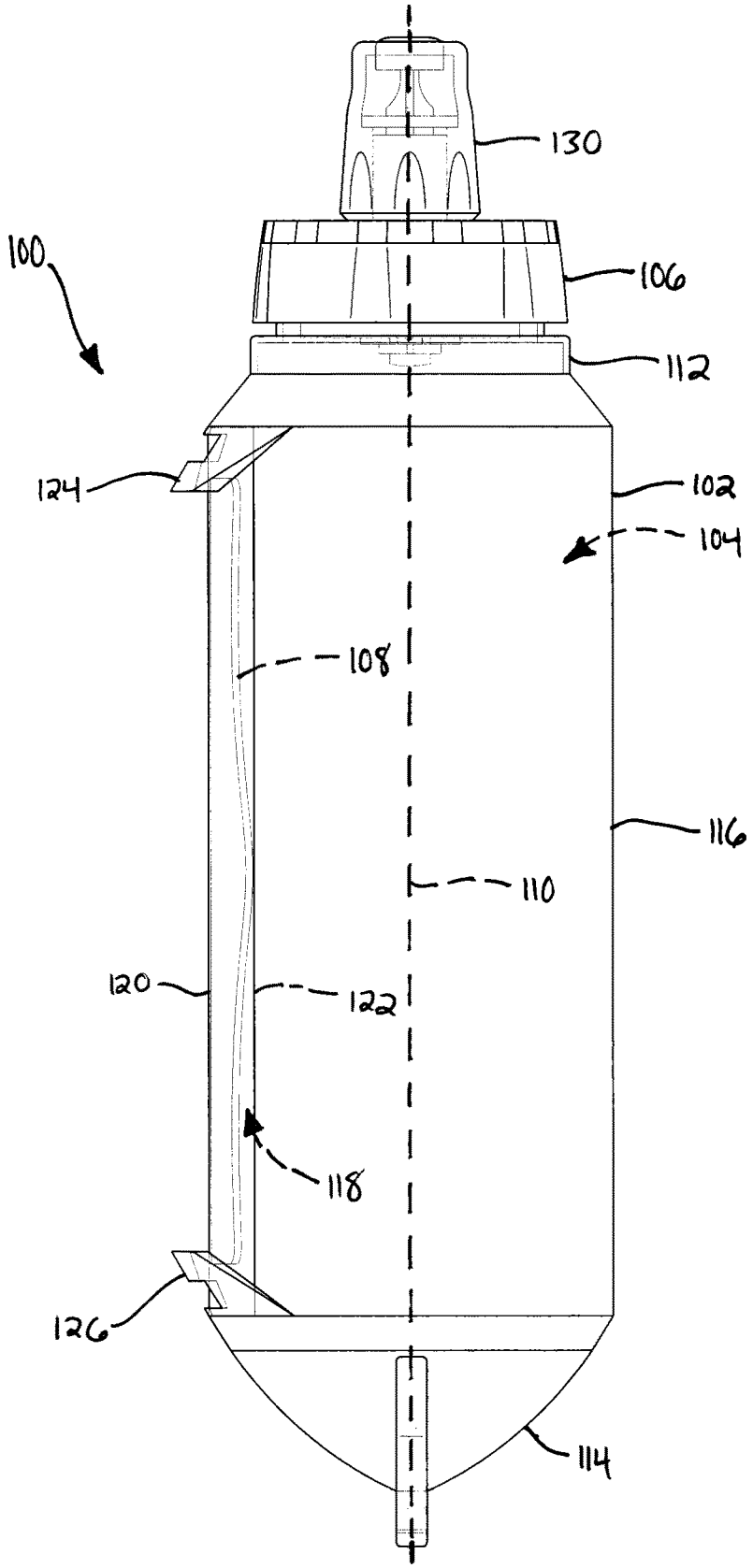
FIG. 19 is a right side view of the hydration bladder of FIG. 15.
Figure 20:
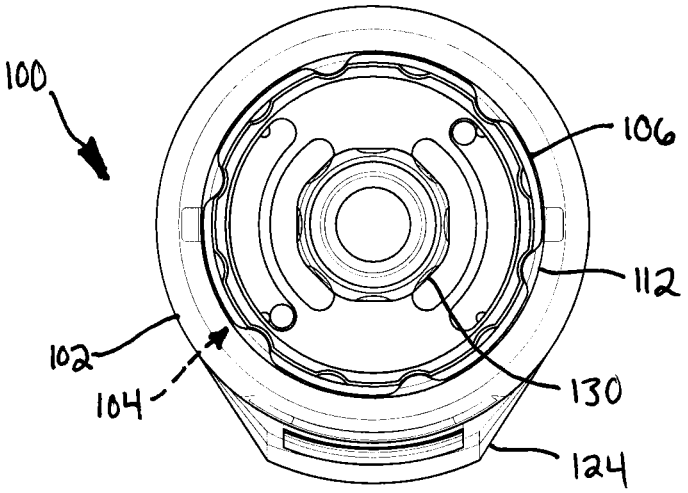
FIG. 20 is a top view of the hydration bladder of FIG. 15.
Figure 21:
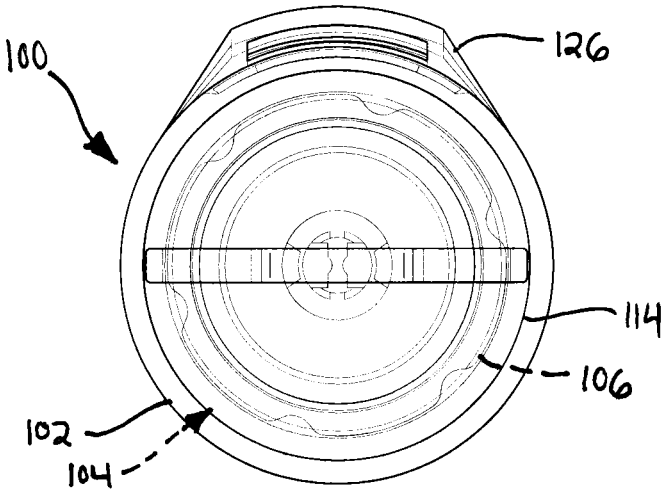
FIG. 21 is a bottom view of the hydration bladder of FIG. 15.
Figure 22:
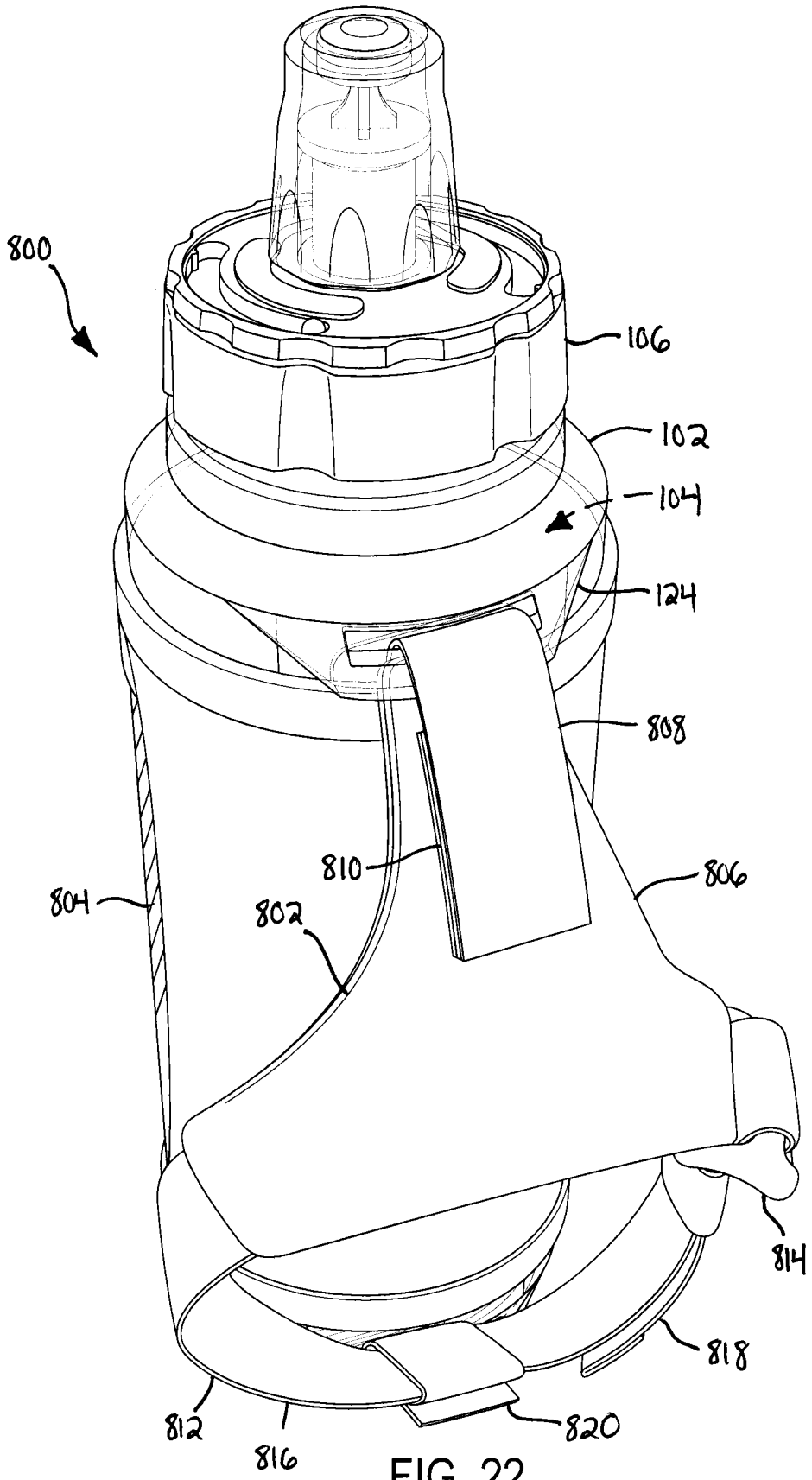
FIG. 22 is a perspective view of the hydration bladder of FIG. 8 in a filled state.
Figure 23:
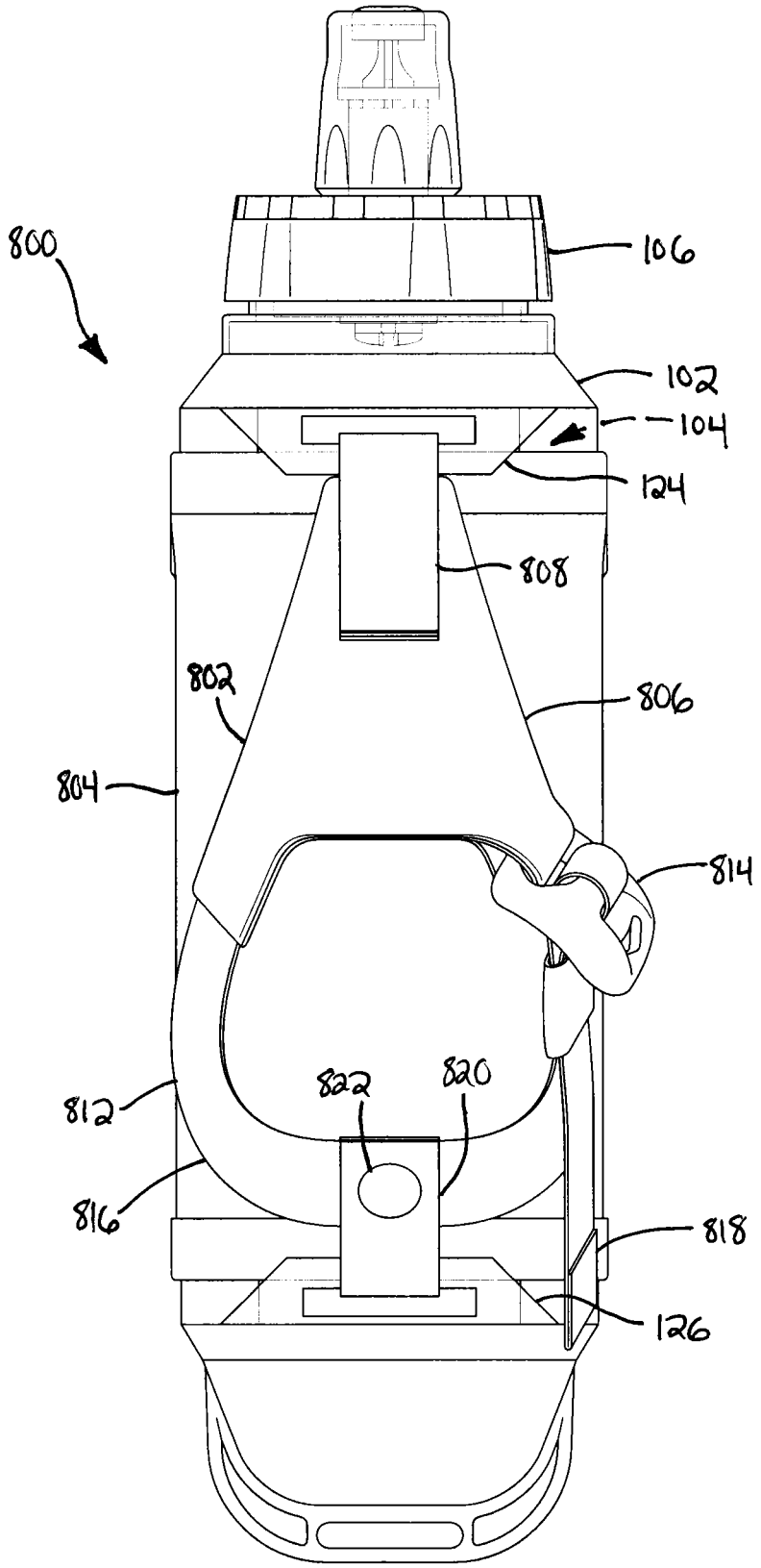
FIG. 23 is a front view of the hydration bladder of FIG. 22.
Figure 24:
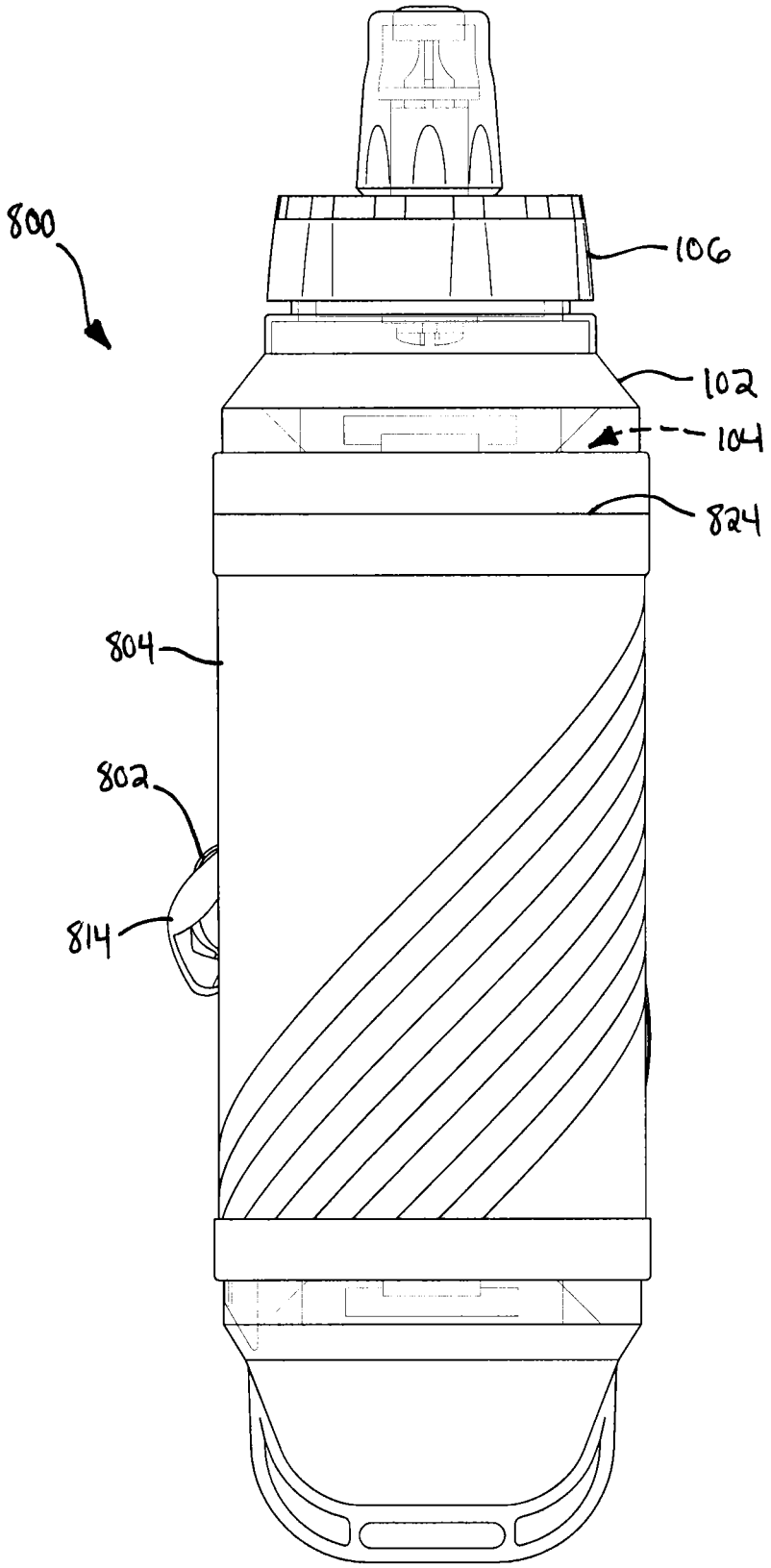
FIG. 24 is a back view of the hydration bladder of FIG. 22.
Figure 25:
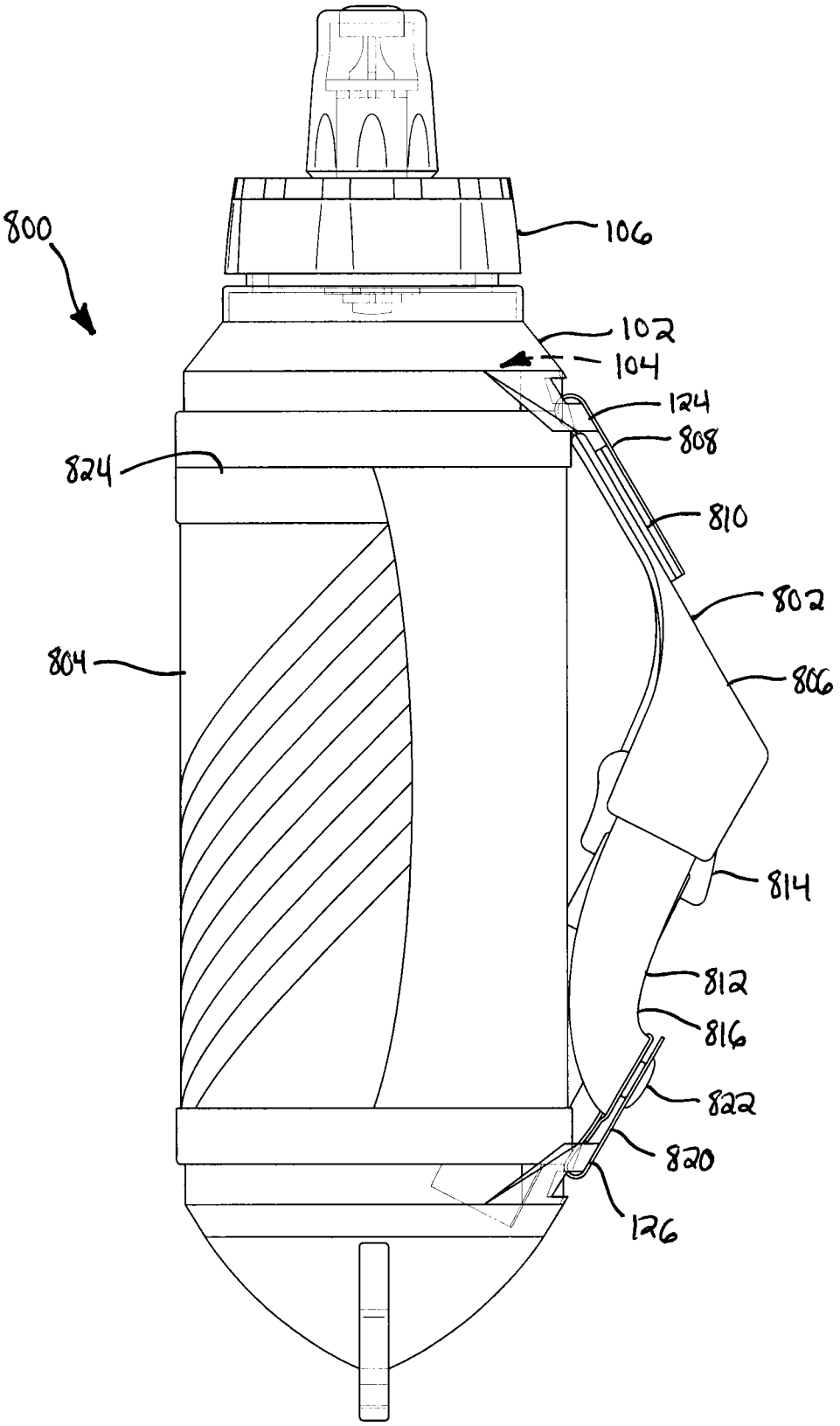
FIG. 25 is a left side view of the hydration bladder of FIG. 22.
Figure 26:
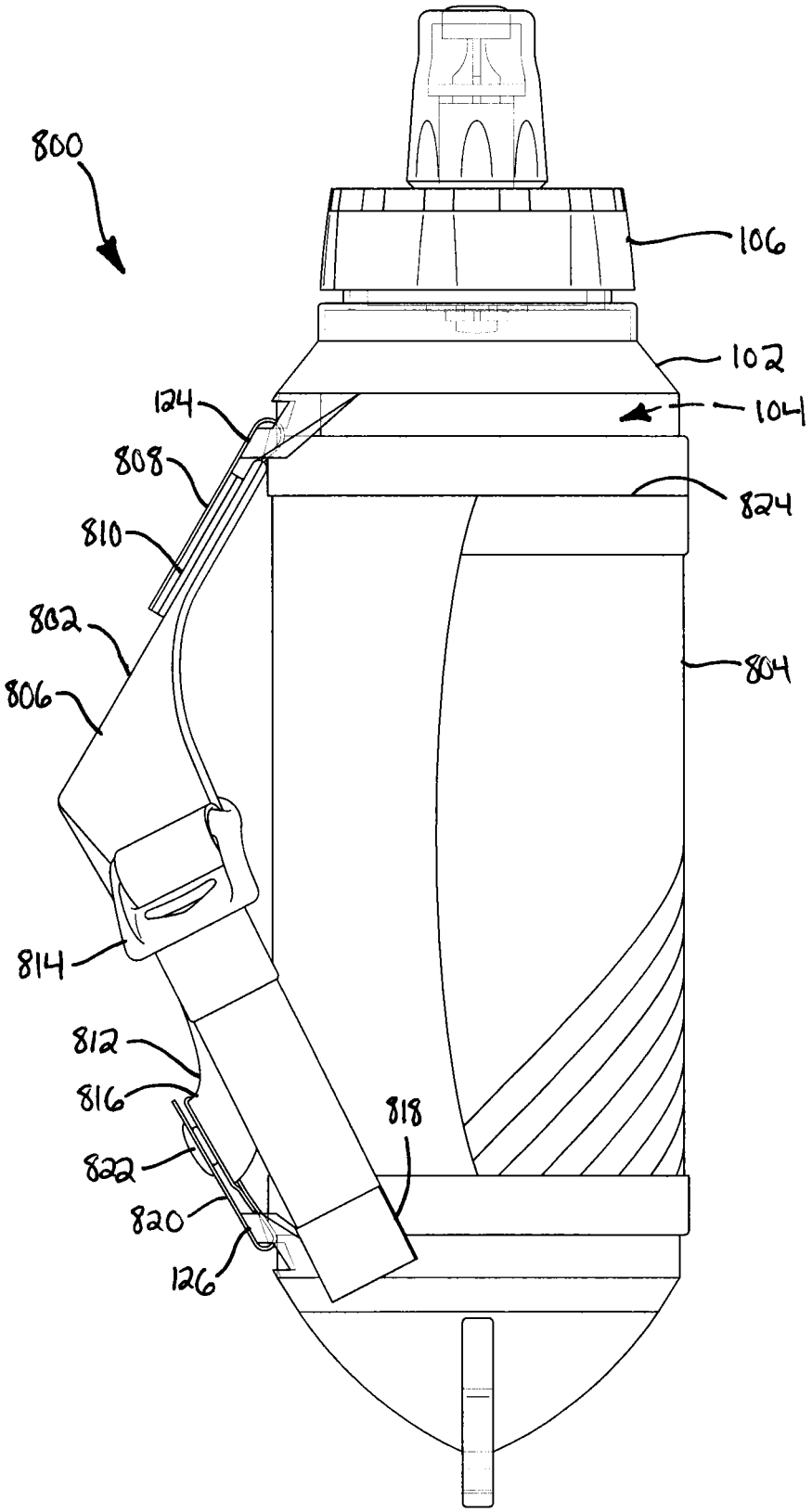
FIG. 26 is a right side view of the hydration bladder of FIG. 22.
Figure 27:
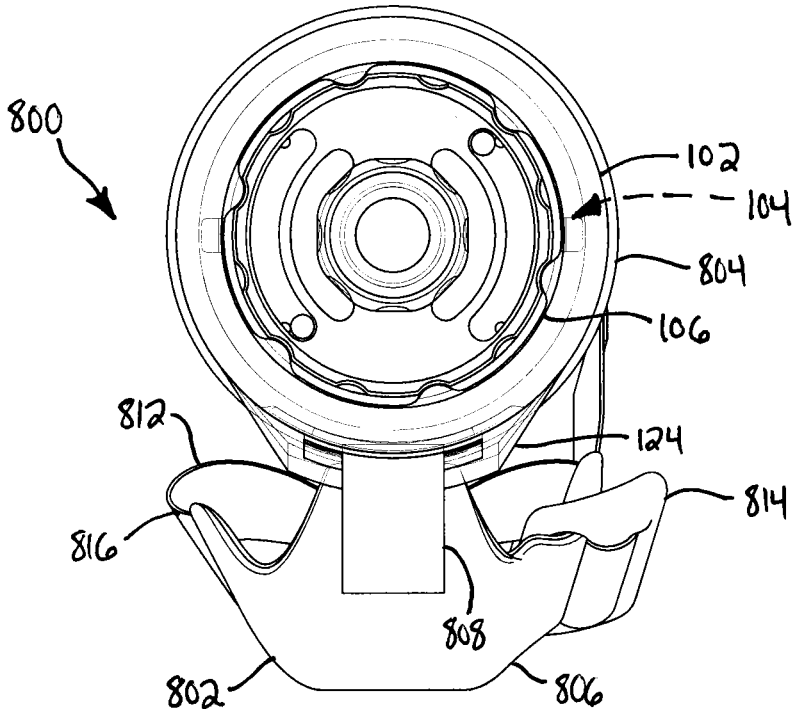
FIG. 27 is a top view of the hydration bladder of FIG. 22.
Figure 28:
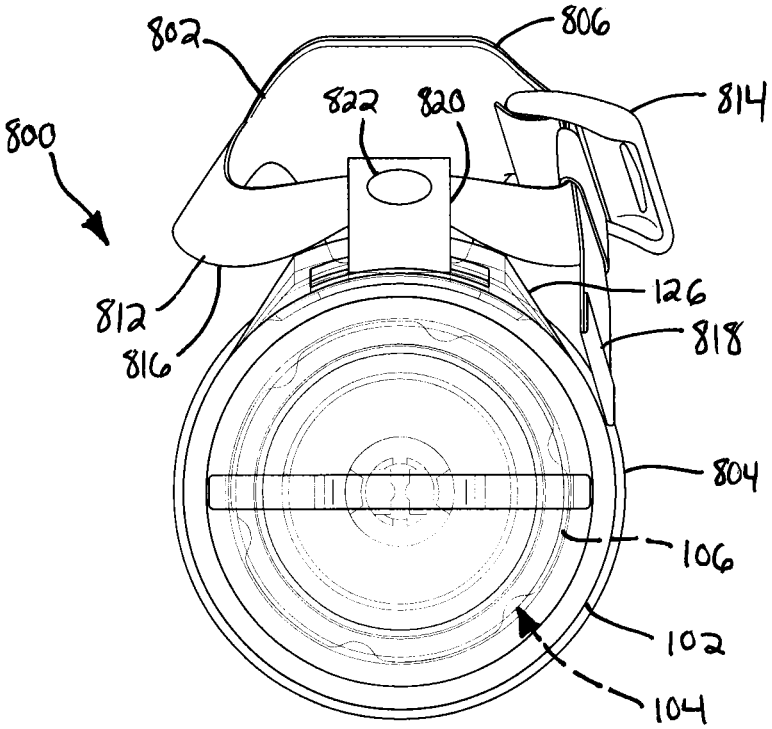
FIG. 28 is a bottom view of the hydration bladder of FIG. 22.

In some embodiments and as shown in the figures, the reinforcement member 108 has a convex outer surface 150 (that is, a convex surface that faces away from the longitudinal axis 110; see FIG. 2). In some embodiments and as shown in the figures, the reinforcement member 108 has a concave inner surface 152 (that is, a concave surface that faces toward the longitudinal axis 110; see FIG. 3).

In some embodiments, the reinforcement member 108 varies in other manners to enhance the stiffness of the member 108. For example, the reinforcement member 108 may include reinforcement elements (not shown), such as elongated rods, that are carried by a base material with a relatively low stiffness. As another example, the reinforcement member 108 may include different and/or non-uniform cross-sections. As another example, the reinforcement member 108 may be foldable (for example, via one or more hinges). As yet another example, the outer surface 150 and the inner surface 152 of the reinforcement member 108 may be curved in other manners or may be flat. In some embodiments, the flexible body 102 may carry a plurality of reinforcement members 108.

Figure 30:
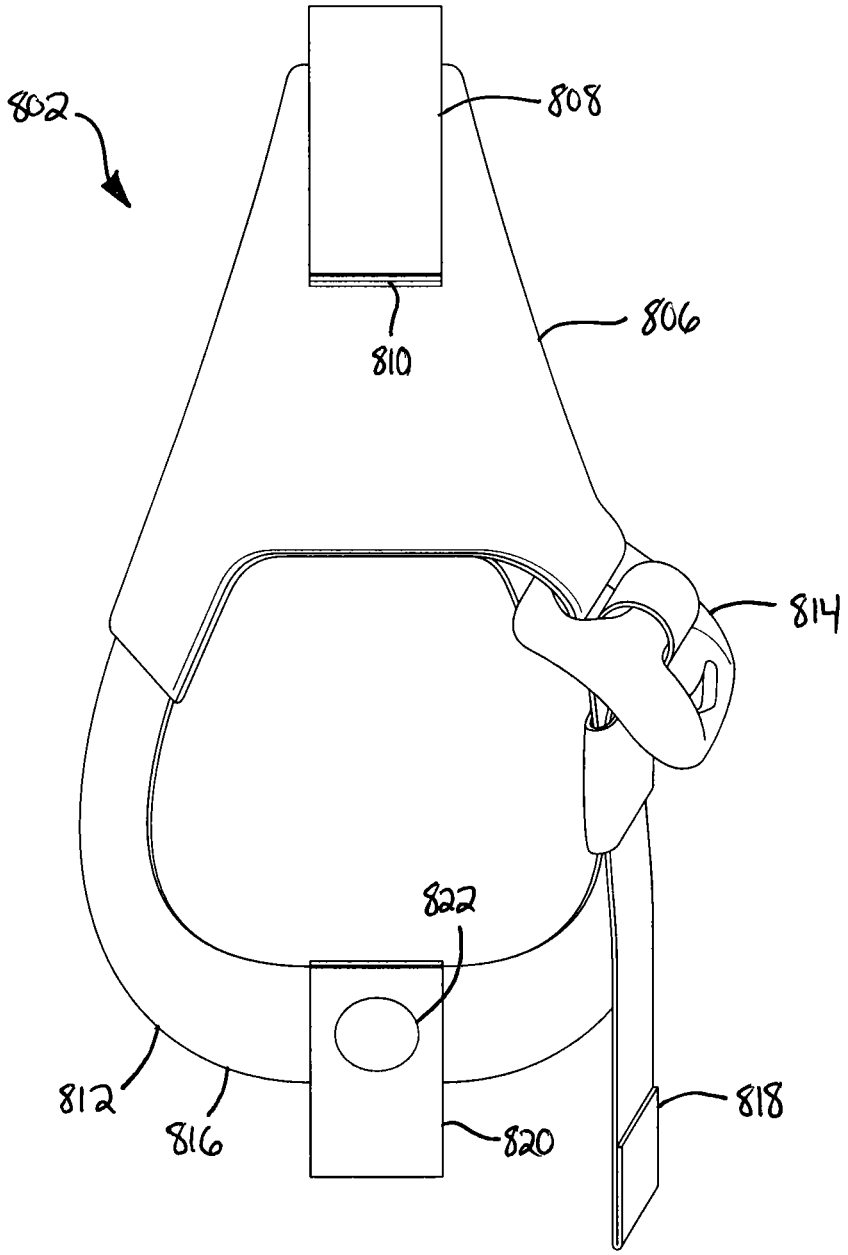
FIG. 30 is a front view of hand harness of the hydration bladder of FIG. 8.

Returning now to FIGS. 8-14 and 22-28 and with additional reference to FIG. 30, the hand harness 802 may generally be formed of various materials, such as woven fibers, knitted fibers, flexible polymers, or the like. In some embodiments, the hand harness 802 includes a main hub 806 that couples to a first coupling strap 808. The first coupling strap 808 extends from the main hub 806, through the first eyelet 124 of the flexible body 102, and detachably couples to itself and/or the main hub 806 (via a hook-and-loop fastener 810 (see FIGS. 11 and 12), a snap fastener, or the like). Opposite the first coupling strap 808, the main hub 806 couples to a hand strap 812 and an adjustment buckle 814. Together, the main hub 806, hand strap 812, and the adjustment buckle 814 form a loop 816 that is configured to receive and engage the hand of the user. A free end 818 of the hand strap 812 passes through the adjustment buckle 814, and the hand strap 812 may be displaced through the adjustment buckle 814 to modify the size of the loop 816. The hand strap 812 couples to second coupling strap 820 opposite the main hub 806. The second coupling strap 820 extends from the hand strap 812, through the second eyelet 126 of the flexible body 102, and detachably couples to itself and/or the hand strap 812 (via a snap fastener 822, a hook-and-loop fastener, or the like).

In some embodiments, the jacket 804 is a flexible component that is detachably carried by the elongated portion 116 of the flexible body 102. The jacket 804 may be formed of various materials, such as woven fibers, knitted fibers, polymer foams, or the like. In some embodiments, the jacket 804 includes a pocket 824 for carrying items (for example, identification cards, keys, or the like).

In some embodiments, any of the properties described herein (for example, elastic modulus or stiffness) may be measured using available ISO/ASTM standards or other test methods commonly associated with such metrics.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

What is claimed is:

1. A hydration bladder comprising:

a collapsible and flexible body having a first stiffness and forming an internal liquid chamber configured to carry a liquid therein, the body having a longitudinal axis extending between an opening portion and an end portion opposite the opening portion, the body further including an elongated portion extending along the longitudinal axis of the body between the opening portion and the end portion;

a port coupled to the opening portion of the body and in communication with the internal liquid chamber;

a reinforcement member chamber coupled to the body, wherein the opening portion and the end portion of the body are disposed externally from the reinforcement member chamber and the liquid chamber of the body is disposed externally from the reinforcement member chamber;

a reinforcement member non-removably disposed within the reinforcement member chamber and substantially angularly aligned with the longitudinal axis of the body, the reinforcement member having a second stiffness, the second stiffness being greater than the first stiffness, the reinforcement member comprising:

a first width in a width direction substantially perpendicular to the longitudinal axis;

a second width in the width direction, the second width being greater than the first width; and a third width in the width direction, the third width disposed on an opposite of the second width than the first width, and the third width being less than the second width.

2. The hydration bladder of claim 1, wherein the reinforcement member comprises a global maximum width, the global maximum width being the second width.

3. The hydration bladder of claim 1, wherein the reinforcement member is symmetric over a plane intersecting with the width direction and extending in a thickness direction, the thickness direction being substantially perpendicular to the longitudinal axis and the width direction.

4. The hydration bladder of claim 1, wherein the reinforcement member is symmetric over a plane intersecting with the longitudinal axis and extending in a thickness direction, the thickness direction being substantially perpendicular to the longitudinal axis and the width direction.

5. The hydration bladder of claim 1, wherein the reinforcement member has a concave surface facing toward the longitudinal axis of the body.

6. The hydration bladder of claim 1, wherein the first width is from 55 percent to 85 percent of the second width.

7. The hydration bladder of claim 6, wherein the third width is from 55 percent to 85 percent of the second width.

8. A hydration bladder comprising:

a flexible body having a longitudinal axis extending between an opening portion and an end portion opposite the opening portion, and the flexible body having a first stiffness;

a port coupled to the opening portion of the flexible body;

a liquid chamber formed by the flexible body, the liquid chamber configured to carry a liquid therein and in communication with the port; and a reinforcement member chamber coupled to the flexible body;

a reinforcement member non-removably disposed within the reinforcement member chamber, the reinforcement member having a second stiffness, the second stiffness being greater than the first stiffness, the reinforcement member terminating apart from the opening portion of the flexible body, and the reinforcement member further comprising:

a length in a length direction substantially parallel to the longitudinal axis;

a first width in a width direction substantially perpendicular to the length direction;

a global maximum width in the width direction;

a third width in the width direction, the third width disposed on an opposite side of the global maximum width than the first width, and the third width being less than the global maximum width.

9. The hydration bladder of claim 8, wherein the reinforcement member is symmetric over a plane intersecting with the width direction and extending in a thickness direction, the thickness direction being substantially perpendicular to the length direction and the width direction.

10. The hydration bladder of claim 8, wherein the reinforcement member is symmetric over a plane intersecting with the length direction and extending in a thickness direction, the thickness direction being substantially perpendicular to the length direction and the width direction.

11. The hydration bladder of claim 8, wherein the reinforcement member has a concave surface facing toward the longitudinal axis of the body.

12. The hydration bladder of claim 8, wherein the global maximum width is from 14 percent to 44 percent of the length.

13. The hydration bladder of claim 8, wherein the first width is from 55 percent to 85 percent of the global maximum width.

14. The hydration bladder of claim 13, wherein the third width is from 55 percent to 85 percent of the global maximum width.

15. The hydration bladder of claim 8, wherein the opening portion and the end portion of the body are disposed externally from the reinforcement member chamber.

* * * * *